US008640304B2

(12) United States Patent
Conrad

(10) Patent No.: US 8,640,304 B2
(45) Date of Patent: Feb. 4, 2014

(54) CYCLONE CONSTRUCTION FOR A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 945 days.

(21) Appl. No.: 12/723,138

(22) Filed: Mar. 12, 2010

(65) Prior Publication Data

US 2011/0219574 A1 Sep. 15, 2011

(51) Int. Cl.
*B01D 45/16* (2006.01)

(52) U.S. Cl.
USPC ..... 15/353; 15/352; 55/428; 55/432; 55/433; 55/DIG. 3

(58) Field of Classification Search
USPC ..... 15/352, 353; 55/DIG. 3, 429, 432, 433
See application file for complete search history.

(56) References Cited

U.S. PATENT DOCUMENTS

| | | | | |
|---|---|---|---|---|
| 5,078,761 | A | 1/1992 | Dyson | |
| 6,406,505 | B1 * | 6/2002 | Oh et al. | 55/337 |
| 6,874,197 | B1 * | 4/2005 | Conrad et al. | 15/353 |
| 7,175,682 | B2 * | 2/2007 | Nakai et al. | 55/429 |
| 7,740,676 | B2 * | 6/2010 | Burnham et al. | 55/345 |
| 7,779,506 | B2 * | 8/2010 | Kang et al. | 15/353 |
| 7,803,207 | B2 | 9/2010 | Conrad | |
| 7,867,308 | B2 * | 1/2011 | Conrad | 55/345 |
| 7,938,871 | B2 * | 5/2011 | Lloyd | 55/337 |
| 8,021,453 | B2 * | 9/2011 | Howes | 55/447 |
| 2002/0178698 | A1 * | 12/2002 | Oh et al. | 55/337 |
| 2005/0138763 | A1 * | 6/2005 | Tanner et al. | 15/353 |
| 2005/0198770 | A1 * | 9/2005 | Jung et al. | 15/353 |
| 2006/0037172 | A1 * | 2/2006 | Choi | 15/353 |
| 2007/0209335 | A1 * | 9/2007 | Conrad | 55/337 |
| 2008/0047091 | A1 * | 2/2008 | Nguyen | 15/300.1 |

FOREIGN PATENT DOCUMENTS

WO 2009/026709 A1 3/2009

* cited by examiner

*Primary Examiner* — Joseph J Hail
*Assistant Examiner* — Henry Hong
(74) *Attorney, Agent, or Firm* — Philip C. Mendes da Cos; Bereskin & Parr LLP/S.E.N.C.R.L., s.r.l.

(57) ABSTRACT

The surface cleaning apparatus includes a cyclone positioned in am air flow passage. The cyclone has a cyclone air inlet and a cyclone air outlet, a dirt outlet spaced from the cyclone air inlet, a cyclone chamber wall and a longitudinal axis. The surface cleaning apparatus also includes a dirt collection chamber in communication with the dirt outlet. The dirt collection chamber has an openable wall mounted to the surface cleaning apparatus by a hinge and a centrally positioned longitudinal axis, the openable wall has a center and a hinge side. The surface cleaning apparatus also includes a plate positioned at an interface of the dirt collection chamber and the cyclone. The plate is moveably mounted to the openable wall. The surface cleaning apparatus also includes a biasing member biasing the plate towards the hinge side of the openable wall a suction motor positioned in the air flow passage.

28 Claims, 18 Drawing Sheets

CYCLONE CONSTRUCTION FOR A SURFACE CLEANING APPARATUS

FIELD

The disclosure relates to surface cleaning apparatuses, such as vacuum cleaners. Particularly, the disclosure relates to a cyclone for surface cleaning apparatuses having cyclone chamber, dirt collection chamber and a movable plate at the interface therebetween and/or an airflow conduit extending through the dirt collection chamber.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

A surface cleaning apparatus is provided with at least one cyclone. The cyclone has an associated dirt collection chamber and a plate or bottom floor positioned at the dirt outlet of the cyclone. The dirt outlet may be an annular gap around the plate or a gap between the plate and an end of the cyclone wall (e.g., a side or slot dirt outlet). In order to increase the dirt collection capacity of the surface cleaning apparatus, the height of the dirt collection chamber may be increased. The increase in height permits additional dirt to accumulate in the dirt collection chamber before the dirt collection chamber has to be emptied. In order to permit the dirt collection chamber to be emptied, an openable wall, preferably an openable bottom wall is provided. In order to permit the cyclone chamber to also be opened, the floor or plate may be moveably mounted (i.e., the floor or plate may be attached to the openable wall. Therefore, when the wall is opened, the plate is moved out of its closed position and material collected in the dirt collection chamber and the cyclone chamber may fall out. The plate may be mounted off centre of the dirt chamber and/or pivotally mounted to the openable wall. Accordingly, despite the height of the bin, the plate or floor may be moved sufficiently so that material may fall out of the cyclone chamber and the dirt collection chamber essentially unimpeded.

A dirt collection chamber having an increased dirt capacity may also be provided by positioning the dirt collection chamber at least partially under the cyclone chamber and, preferably the dirt collection chamber may extend under the entire cyclone chamber. A surface cleaning apparatus, such as an upright vacuum cleaner may have the suction motor and the cyclone provided on the upper section. The cyclone is preferably provided above the suction motor so that the suction motor is at a lower height on the upper section, thereby reducing the hand weight of the upper section. In order to permit the air to flow to the suction motor from the cyclone with reduced back pressure, the cyclone air outlet may extend through the dirt collection chamber (e.g., the cyclone air outlet may have an extension of the vortex finder extend through the dirt collection chamber. In order to empty the dirt collection chamber, the bottom may be openable. The extension may be mounted to the cyclone chamber and remain in position when the bottom is opened. Alternately, the extension may be affixed to the bottom and therefore removed when the bottom is opened. Alternately, part may be affixed to the bottom and part to the cyclone so that part of the extension is removed. It is preferred that the extension is sealed on an angle when in the closed position (e.g. 45 degrees).

According to one aspect, a surface cleaning apparatus comprises an air flow passage extending from a dirty air inlet to a clean air outlet. The surface cleaning apparatus also includes a cyclone positioned in the air flow passage. The cyclone has a cyclone air inlet and a cyclone air outlet at one end of a cyclone chamber, a dirt outlet spaced from the cyclone air inlet, a cyclone chamber wall, and a centrally positioned longitudinal axis. The surface cleaning apparatus also includes a dirt collection chamber in communication with the dirt outlet. The dirt collection chamber has an openable wall mounted to the surface cleaning apparatus by a hinge and a centrally positioned longitudinal axis, the openable wall has a centre and a hinge side. The surface cleaning apparatus also includes a plate positioned at an interface of the dirt collection chamber and the cyclone. The plate is moveably mounted to the openable wall. The surface cleaning apparatus also includes a biasing member biasing the plate towards the hinge side of the openable wall a suction motor positioned in the air flow passage.

In some examples the plate is mounted to the openable wall at a position off centre from the centrally positioned longitudinal axis of the cyclone.

In some examples the plate is mounted to the openable wall spaced from the centre of the openable wall and towards the hinge side.

In some examples the surface cleaning apparatus also includes a support member extending between the openable wall and the plate. The support member extends at an angle to the longitudinal axis of the cyclone.

In some examples the dirt outlet comprises a gap between the plate and the cyclone chamber wall.

In some examples the dirt collection chamber has a longitudinally extending wall and the plate has a perimeter that is spaced from at least a portion of the longitudinally extending wall by a distance and the distance varies.

In some examples the surface cleaning apparatus also includes an abutment member provided in the dirt collection chamber on the hinge side. The abutment member is positioned to interact with at least one of the plate and a moveable plate mount and move the plate in a direction counter the a force exerted by the biasing member as the openable wall is closed.

In some examples the dirt collection chamber has a longitudinally extending wall, a portion of which on the hinge side comprises the abutment member, and the plate has a perimeter that is spaced from a portion of the longitudinally extending wall and abuts the portion of the longitudinally extending wall that comprises the abutment member when the openable wall is closed.

In some examples the abutment member comprises a rib provided on the longitudinally extending wall of the dirt collection chamber.

In some examples the axis of the dirt collection chamber is spaced apart from the longitudinal axis of the cyclone chamber.

In accordance with another aspect, a surface cleaning apparatus comprises an air flow passage, extending from a dirty air inlet to a clean air outlet, and a cyclone positioned in the air flow passage. The cyclone has a cyclone air inlet at an inlet end of the cyclone, a cyclone air outlet, a dirt outlet spaced from the cyclone air inlet at a dirt outlet end of the cyclone and a cyclone chamber wall. The surface cleaning apparatus also includes a dirt collection chamber, in communication with the dirt outlet and having an openable wall, and a plate positioned at the dirt outlet end of the cyclone and moveably mounted to the openable wall. The surface cleaning apparatus also includes a suction motor positioned in the air flow passage.

In some examples the surface cleaning apparatus further comprises a biasing member biasing the plate towards a sidewall of the dirt collection chamber.

In some examples the surface cleaning apparatus further comprises an abutment member positioned in the dirt collection chamber and engageable with at least one of the plate and a plate mount whereby, when the openable wall is closed, the abutment member positions the plate at a preset position.

In some examples the dirt collection chamber has a longitudinally extending wall and the plate has a perimeter that is spaced from a portion of the longitudinally extending wall by a distance and the distance varies.

In some examples a portion of the longitudinally extending wall comprises the abutment member and the plate abuts the abutment member when the openable wall is closed.

In some examples the openable wall is moveably mounted to the surface cleaning apparatus, the openable wall has a centre and a hinge side, and the plate is mounted to the openable wall spaced from the centre and towards the hinge side.

In some examples the surface cleaning apparatus also comprises a plate mount provided on the openable wall and the plate mount is positioned spaced from a centrally positioned longitudinal axis of the cyclone.

In some examples each of the dirt collection chamber and the cyclone has a centrally positioned longitudinal axis and the axes are spaced apart.

In some examples the surface cleaning apparatus further comprises a support member extending between the openable wall and the plate and the support member extends at an angle to a longitudinal axis of the cyclone.

In some examples the dirt outlet comprises a gap between the plate and the cyclone chamber wall.

In some examples the cyclone air outlet is at the inlet end of the cyclone.

In accordance with another aspect, a surface cleaning apparatus comprises an air flow passage extending from a dirty air inlet to a clean air outlet and a cyclone positioned in the air flow passage. The cyclone has a cyclone air outlet at one end of a cyclone chamber, a dirt outlet spaced from the cyclone air outlet and a cyclone chamber wall. The surface cleaning apparatus also includes a dirt collection chamber in communication with the dirt outlet and a suction motor positioned in the air flow passage downstream from the cyclone. The air flow passage comprises a portion that extends from the cyclone air outlet to the suction motor, the portion comprises a conduit that extends through the dirt collection chamber.

In some examples the dirt collection chamber extends under the end of the cyclone having the air outlet.

In some examples the conduit is an extension of the vortex finder.

In some examples the cyclone air inlet is positioned at the same end of the cyclone as the cyclone air outlet.

In some examples the dirt collection chamber is external to the cyclone.

In some examples the dirt collection chamber surrounds a portion of the cyclone.

In some examples the dirt collection chamber has an openable end wall. Optionally, the openable end wall has the conduit provided thereon and the conduit is removed from the dirt collection chamber when the openable end wall is opened.

In some examples the surface cleaning apparatus further comprises an openable seal between the conduit and the cyclone.

In some examples the conduit is mounted to the cyclone and extends from the cyclone to the openable end wall.

In some examples the surface cleaning apparatus also includes an openable seal between the conduit and the openable end wall.

In some examples the openable seal is in a plane at an angle to the direction of air flow through the conduit.

In some examples the dirt collection chamber has two opposed openable end walls.

DRAWINGS

Reference is made in the detailed description to the accompanying drawings, in which.

DETAILED DESCRIPTION

Figure 1:
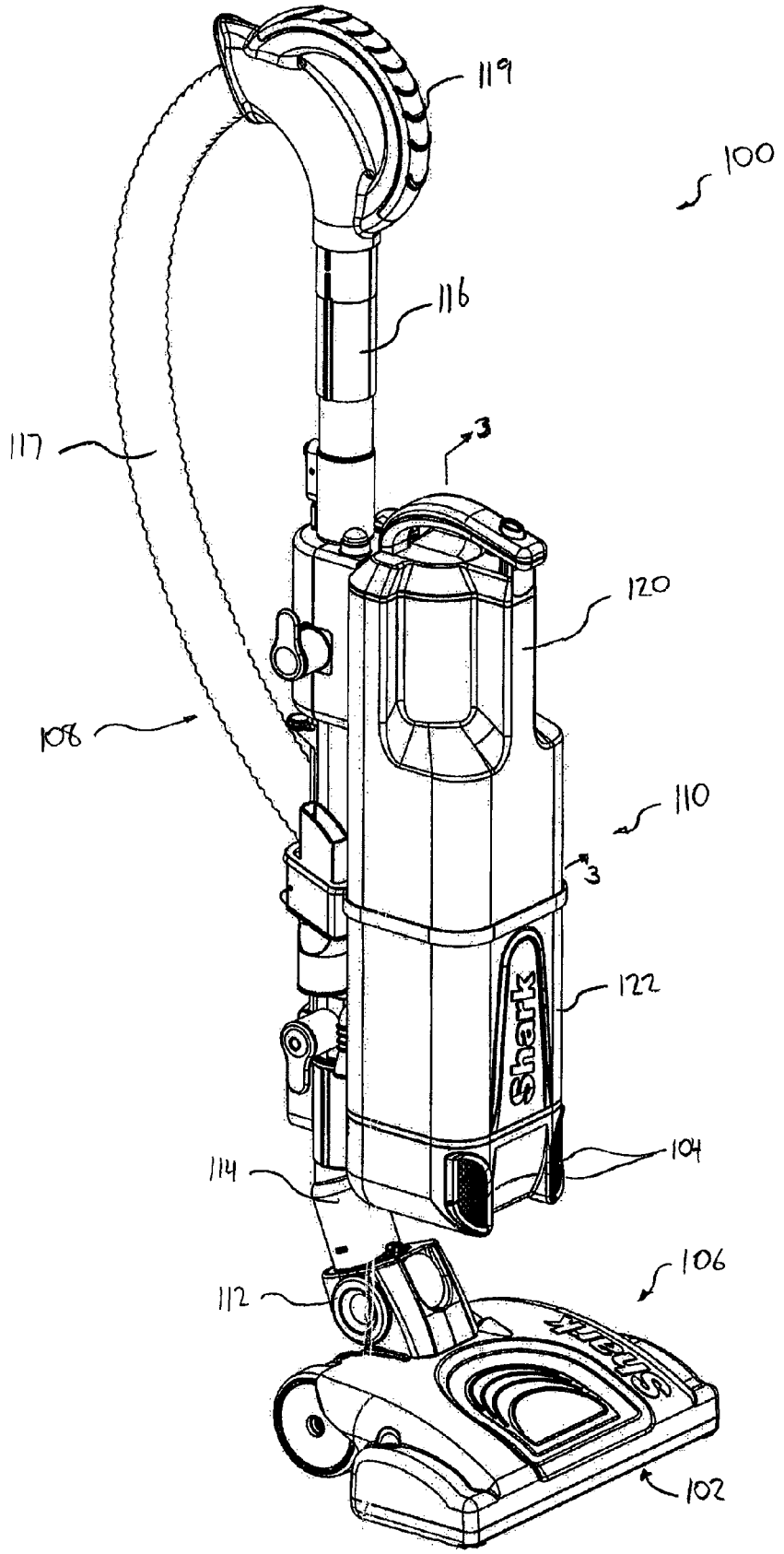
FIG. 1 is a front isometeric view of a surface cleaning apparatus.

Referring to FIG. 1, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

Referring still to FIG. 1, the surface cleaning apparatus 100 has a dirty air inlet 102, a clean air outlet 104, and an air flow passage extending therebetween. In the embodiment shown, the dirty air inlet 102 is provided in a surface cleaning head 106. From the dirty air inlet 102, the airflow passage extends through the surface cleaning head 106, and through an air conduit 108, to a suction and filtration unit 110. The clean air outlet 104 is provided in the suction and filtration unit 110. Optionally, the suction and filtration unit 110 can be releasably mounted to the supporting structure of the surface cleaning apparatus 100. The releasable connection between the suction and filtration unit 110 and the supporting structure can be of any suitable type, and can optionally including locking means for securing the suction and filtration unit 110 in place.

In the embodiment shown, the air conduit 108 includes a pivoting joint member 112 connected to the surface cleaning head 106, a lower upflow duct 114, and an upper upflow duct 116 and a flexible hose 117, in airflow communication with the suction and filtration unit 110. In alternate embodiments, the air conduit 108 may be of another configuration. For example, only a pivoting joint member 112, a lower upflow duct 114, and an elbow joint 118 may be provided.

A handle 119 is mounted to the upper upflow duct 116, to allow a user to manipulate the surface cleaning apparatus 100 and maneuver the surface cleaning head 106 across a surface to be cleaned, for example a floor.

The suction and filtration unit 110 includes a filtration member housing 120, and a suction motor housing 122. The filtration member housing 122 houses filtration member, for example a cyclone, which is positioned in the airflow passage downstream of the dirty air inlet 102 for removing particulate matter from air flowing through the airflow passage. The suction motor housing 122 houses a suction motor (not shown), which is provided in the airflow passage downstream of the cyclone for drawing air through the airflow passage.

In the embodiment shown, as the suction motor housing 122 is mounted to the lower upflow duct 114, and the filtration member housing 120 is removably mounted to the suction motor housing 122 above the suction motor housing 122, the filtration member housing 120 may optionally be secured to the suction motor housing 122 using one or more latches or locking members (not shown). In such instances the filtration member housing 120 can be detached from the suction motor housing by unlatching the one or more latch members, and lifting the filtration member housing 120 off of the suction motor housing 122. When this is done, the filtration member housing 120 will be generally sealed, except for any airflow passages leading to or from the filtration member housing 120, and the top of the suction motor housing 122 will be open. The top of the suction motor housing 122 may be covered with a suitable pre-motor filter positioned upstream of the suction motor and downstream of the cyclone. The suction motor housing 122 may also include a post-motor filter downstream of the suction motor and upstream of the clean air outlet. The post-motor filter may be any suitable type of filter, such as, for example, a HEPA filter.

In one embodiment, as exemplified in FIGS. 2-8, the filtration member housing 120 includes a sidewall 130, a top wall 132, and a bottom wall 134. In the embodiment shown, the filtration member, or cyclone, housed in the filtration member housing 120 is a cyclone 144. In alternate embodiments, the filtration member may be, for example, a filter, such as a filter bag or a foam filter. In further alternate embodiments, the filtration member may include a plurality of cyclones, or a plurality of cyclonic stages.

The cyclone 144 may be of any suitable configuration. In the embodiment shown, the cyclone 144 extends along a longitudinal axis 146, which is generally vertically extending, and includes a generally cylindrical cyclone wall 148, which defines a cyclone chamber 150. Some or all of the cyclone wall 148 can coincide with portions of the side walls 130, as exemplified, for example in FIGS. 3 and 4. Alternatively, in some examples the cyclone wall 148 can be distinct from the side walls 130.

The cyclone 144 is positioned in the air flow passage and has a cyclone air inlet 162 in fluid communication with a cyclone air outlet 164 at one end, for example the upper end 152 of the cyclone chamber 150. The cyclone 144 also includes a cyclone dirt outlet 166 spaced from the cyclone air inlet 162. In the embodiment shown, the cyclone dirt outlet 166 is disposed beneath the open bottom end 154 of the cyclone chamber 150 and is generally opposite the cyclone air outlet 164.

In use, dirty air (i.e. air containing entrained dirt particles and other debris) enters the cyclone chamber 150 via the cyclone air inlet 162. Once in the cyclone chamber 150 the air circulates in a cyclonic manner which causes dirt particles and debris in the air to contact the cyclone chamber wall 148, separating the dirt and debris from the air flow. The relatively clean air is drawn from the cyclone chamber 150, upwards through the cyclone air outlet 164 while the dirt and debris falls downward under the force of gravity and exits the cyclone dirt outlet 166.

The filtration member housing 120 also includes a dirt collection chamber 160 that is in fluid communication with the cyclone dirt outlet 166, for receiving and storing the dirt and debris separated from the air flow using the cyclone 144. The dirt chamber 160 includes an openable wall 170 that is pivotally connected to the filtration member housing 120 by a hinged joint 172. In some examples, the openable wall 170 of the dirt collection chamber 160 also forms the bottom wall 134 of the filtration member housing 120. In other examples, a separate, movable bottom wall 134 can be included beneath the openable wall 170. In the embodiment shown, the openable wall 170 is generally centrally positioned about the longitudinal axis 218 and defines a centre (for example the geometric centre) that separates a hinge side 174 from an opposing latchable side 176. Opening the openable wall 170 enables a user to empty the accumulated dirt and debris from the dirt collection chamber 160.

Figure 3:
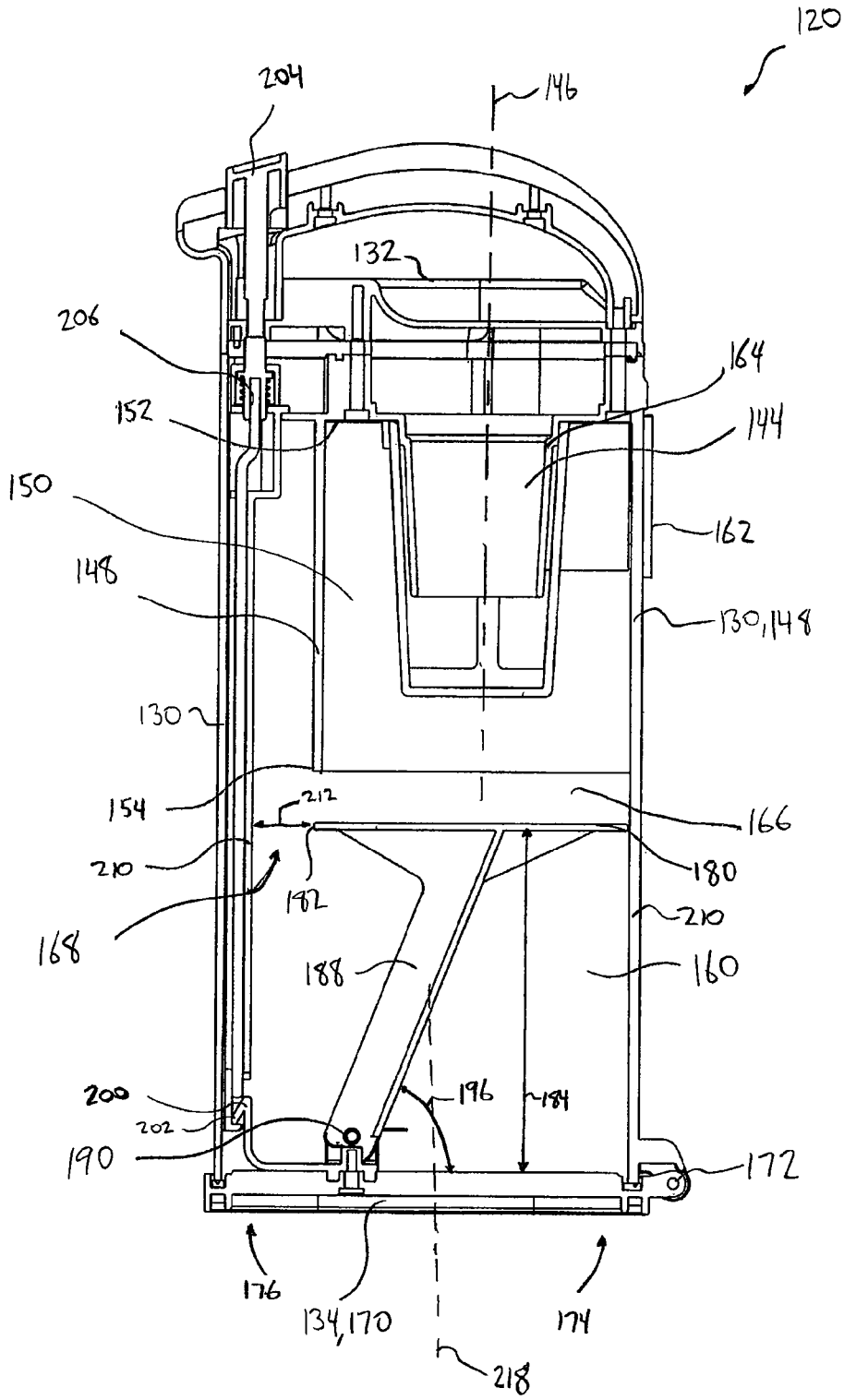
FIG. 3 is a section view of a filtration member housing of the surface cleaning apparatus of FIG. 1, taken along line 3-3.

The openable wall 170 can be held in its closed position by any suitable means including a friction fit, clips, clamps or one or more latches. As exemplified in FIGS. 3-8, one example of a suitable latch includes internal latch member 200, mounted to openable wall 170, that is configured to engage shoulder 202. Latch member 200 can be resiliently biased toward the engaged position, as exemplified in FIG. 3, and when engaged with complimentary should 202, can retain the openable wall 170 in its closed position. When a user wishes open the openable wall 170, a user can depress actuator 204 thereby causing linkage member 206 to translate downward (as shown in FIG. 3), causing a corresponding horizontal deflection (as seen in FIG. 3) of latch member 200, thereby disengaging latch member 200 from shoulder 202. Due to the resilient nature of latch member 200, it will automatically re-engage shoulder 202 when the openable wall 170 is returned to the closed position. In this example the latch member 200 also serves as a plate mount, as described in more detail.

Figure 9:
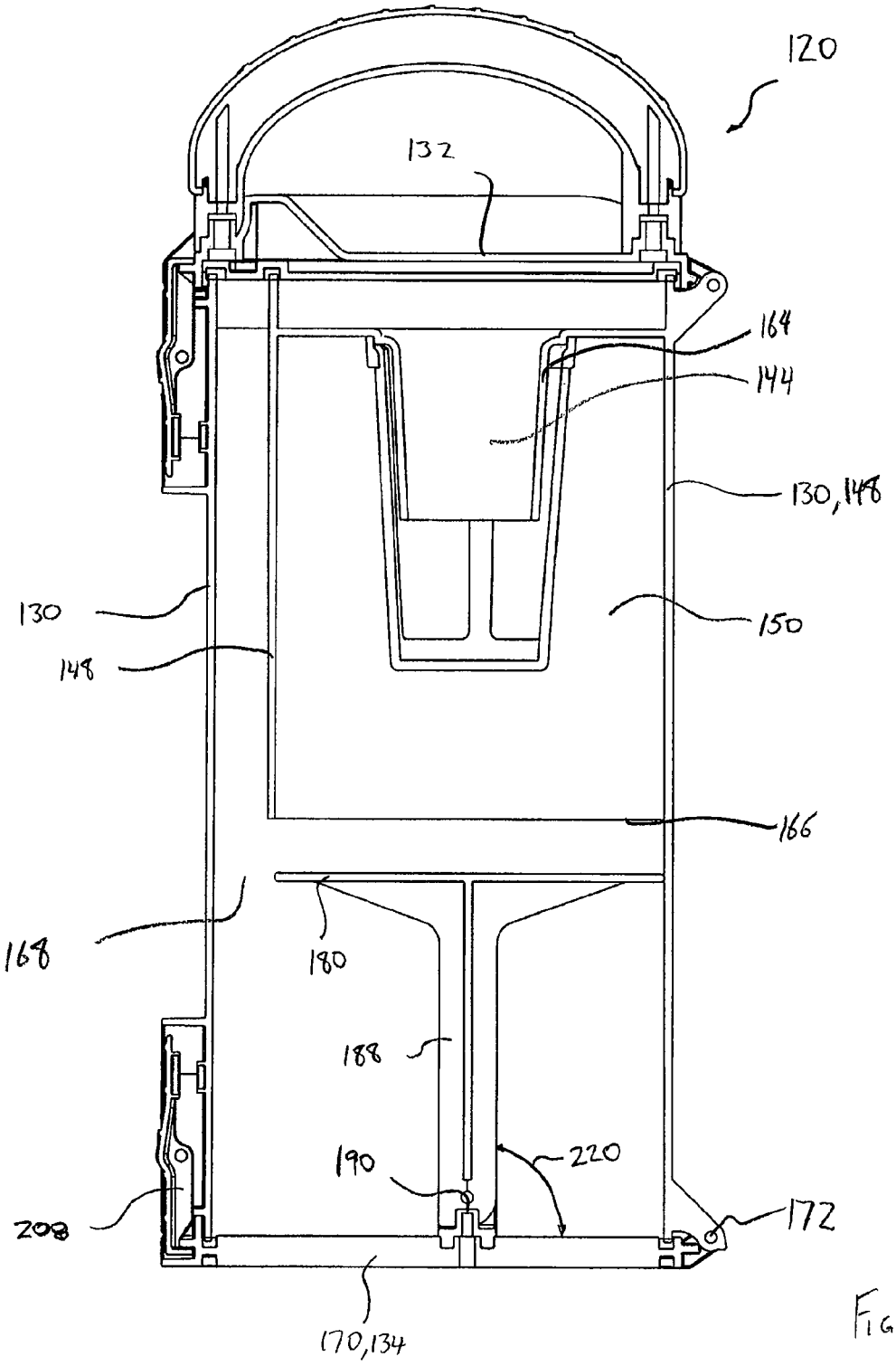
FIG. 9 is a section view of another example of a filtration member housing for the surface cleaning apparatus of FIG. 1, with an openable wall in a closed position.
Figure 10:
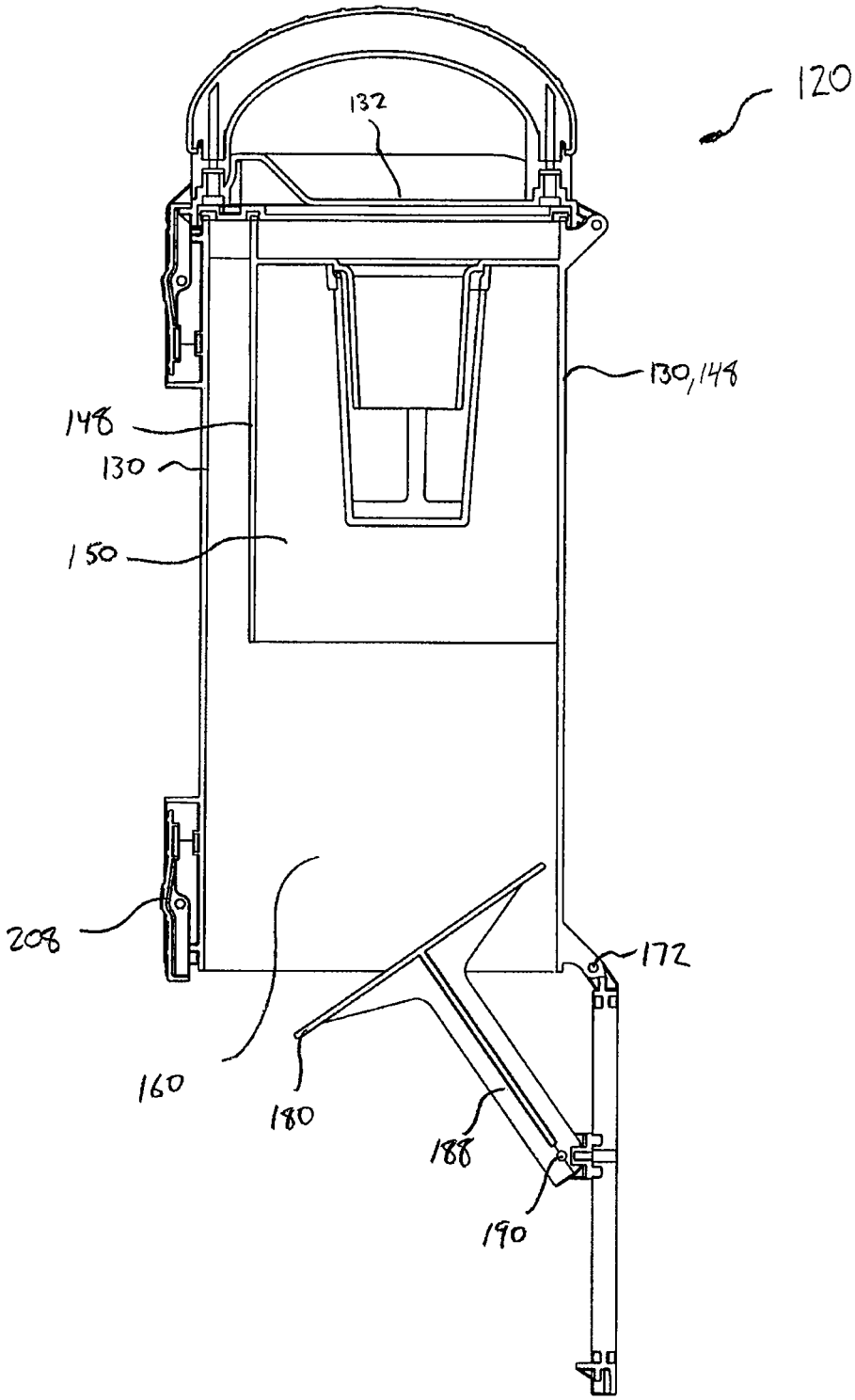
FIG. 10 is the section view of FIG. 9 showing the openable wall member in an open position.

In another example, exemplified in FIGS. 9-10, the latch may be an external latch 208, of any suitable type known in the art, that can be directly accessed by the user.

A deflector or arrester plate is positioned at the interface between the dirt collection chamber 160 and the cyclone 144, for example deflector plate 180 positioned beneath cyclone chamber 150, defining a gap that forms cyclone dirt outlet 166. The deflector plate 180 serves to deflect and re-direct dirt and debris exiting the cyclone chamber 150 toward the dirt collection chamber 160. In the present embodiment, a dirt inlet 168 for the dirt collection chamber 160, through which dirt and debris can enter the dirt collection chamber 160, comprises the generally annular space or gap between the peripheral edge 182 of the deflector plate 180 and the inner surface of the side wall 130. In other examples, the dirt inlet for the dirt collection chamber 160 may be any other suitable configuration.

The deflector plate 180 is mounted to, and supported apart from, the openable wall 170 by a support member, for example a strut 188. The strut 188 may be any type of suitable structural member that is capable of supporting the deflector plate 180 and resisting any stresses exerted on the deflector plate 180 by the air flow or dirt particles passing exiting the cyclone 144. The strut 188 can be connected to the openable wall 170 using any suitable plate mount member, for example pin joint 190. In this example the pin joint 190 also comprises the latch member 200.

In this configuration, the deflector plate 180 also forms the upper wall of the dirt chamber 160. The capacity of the dirt collection chamber 160 (i.e. the volume of dirt that can be stored in the chamber while the surface cleaning apparatus 100 is in use) can be based on the vertical distance 184 between the deflector plate 180 and the openable bottom wall 170. The dirt collection chamber 160 also has at least one longitudinally (vertically as shown) extending wall 210. In some instances the longitudinally extending wall 210 can form a portion of the side walls 130. The deflector plate has a perimeter that is spaced from at least a portion of the longitudinally extending wall 210 of the dirt collection chamber 160 by a distance 212, and the distance 212 varies along the perimeter of the deflector plate 180.

In addition to determining the dirt chamber 160 capacity, the position, size and shape of the deflector plate 180 relative to the cyclone chamber 150 can affect the performance and characteristics of the cyclone 144 in use. In the present embodiment, the deflector plate 180 is substantially the same size and shape as the bottom end 154 of the cyclone chamber 150, and is positioned to overlie substantially all of the cyclone dirt outlet 166. In this configuration substantially all of the dirt exiting the cyclone chamber can contact the deflector plate 180 and be directed to dirt inlet 168.

One method of increasing the capacity of the dirt chamber 160 (thereby increasing the vacuum time between stops to empty the chamber) is to increase the distance 184 between the deflector plate 180 and the openable wall 170, for example by lengthening strut 188. However, in existing examples where the deflector plate was fixedly connected to the openable wall, capacity of the dirt chamber could be limited because increasing the length of strut 188 would result in jamming or interference between the deflector plate 180 and the side walls 130 of the filtration member housing 120 when the openable wall 170 is opened.

Figure 4:
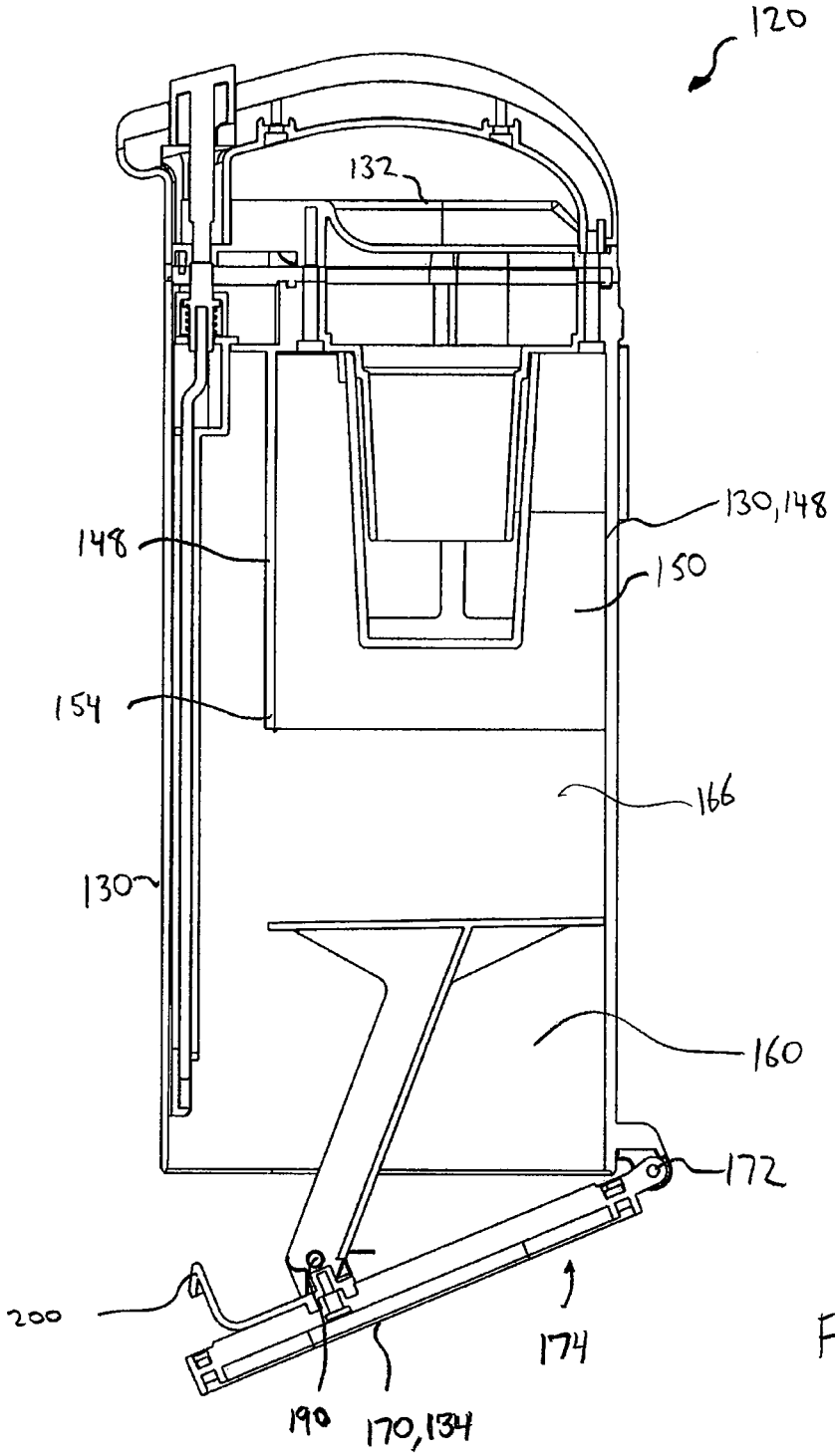
FIG. 4 is the section view of FIG. 3 showing an openable wall in an example of an open position.
Figure 5:
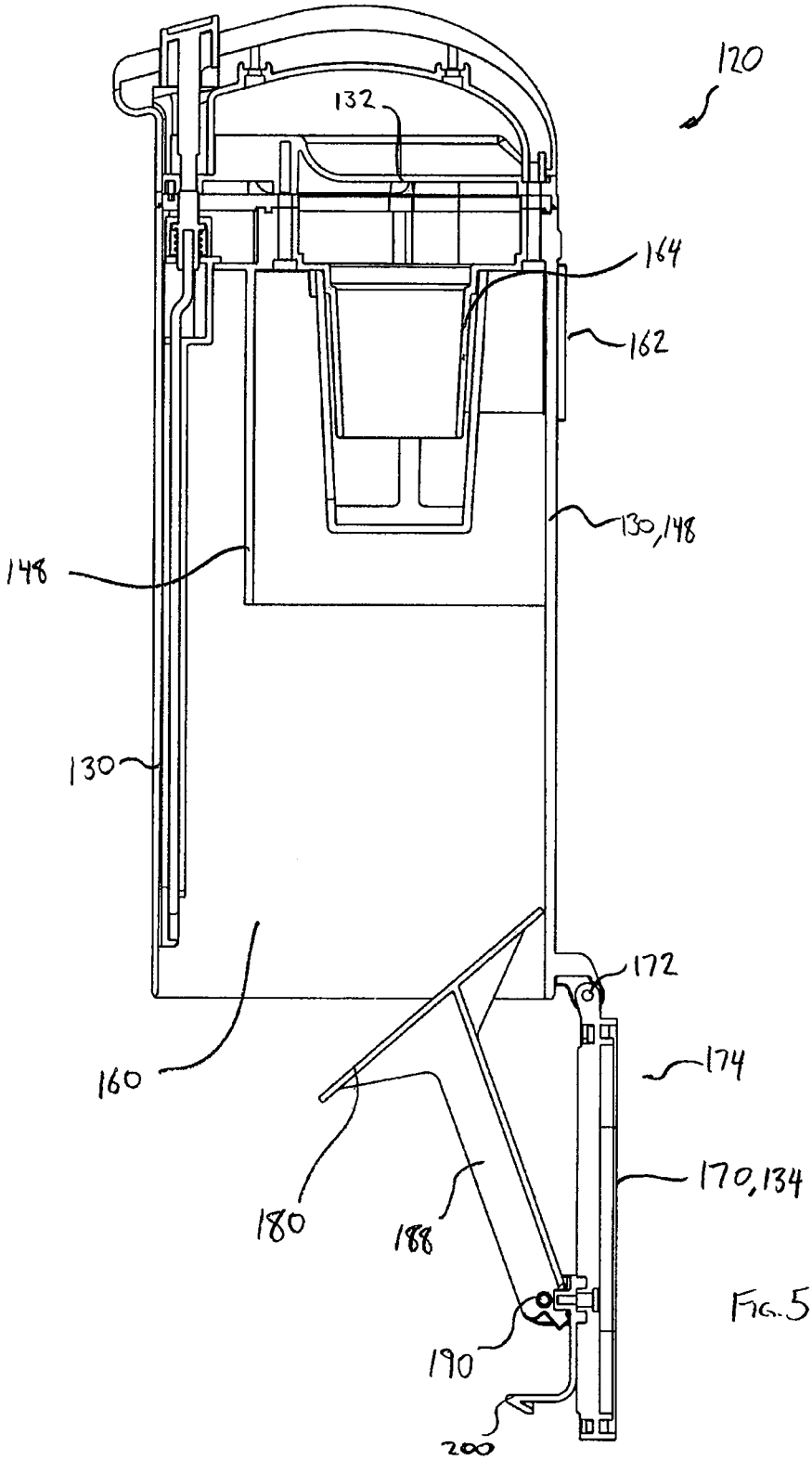
FIG. 5 is the section view of FIG. 3 showing an openable wall in another example of an open position.
Figure 6:
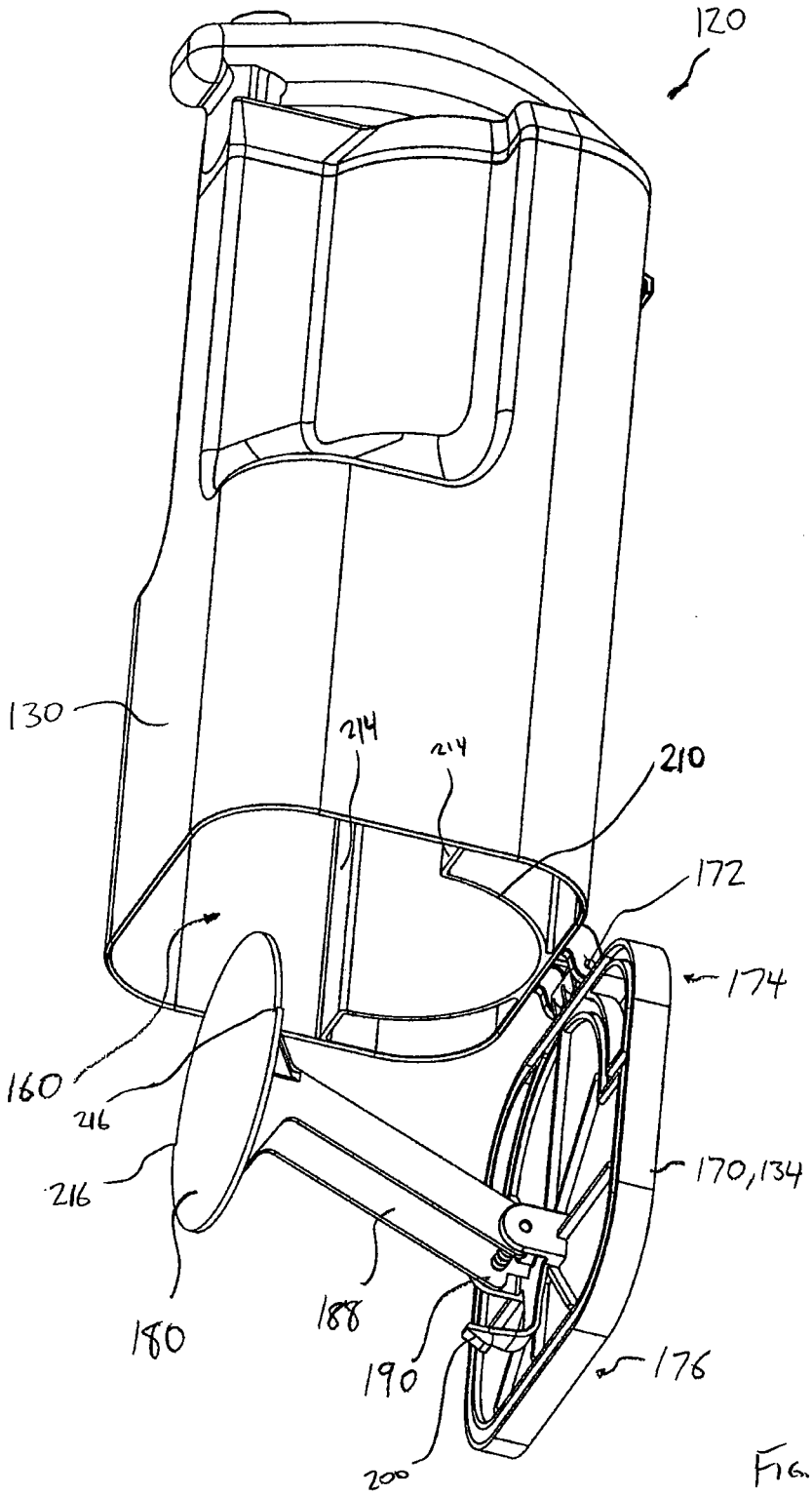
FIG. 6 is the isometric view of FIG. 2 showing an openable wall in another example of an open position.

In the present example, the strut 188 is fixedly connected to the deflector plate 180 and is movably coupled to the openable plate 170 by pin joint 190 (or any other suitable pivotable coupling), which enables the deflector plate 180 to pivot relative to the openable plate 170, as exemplified in FIGS. 4 and 5. The pivotable connection between the strut 188 and the openable wall 170 allows the deflector plate 180 to be spaced further apart from the openable wall 170, which can increase dirt chamber capacity, and enables the deflector plate 180 to be properly positioned relative to the cyclone chamber 150, while still allowing the openable wall 170 to be opened without causing jamming between the deflector plate 180 and the side walls 130.

Figure 8:
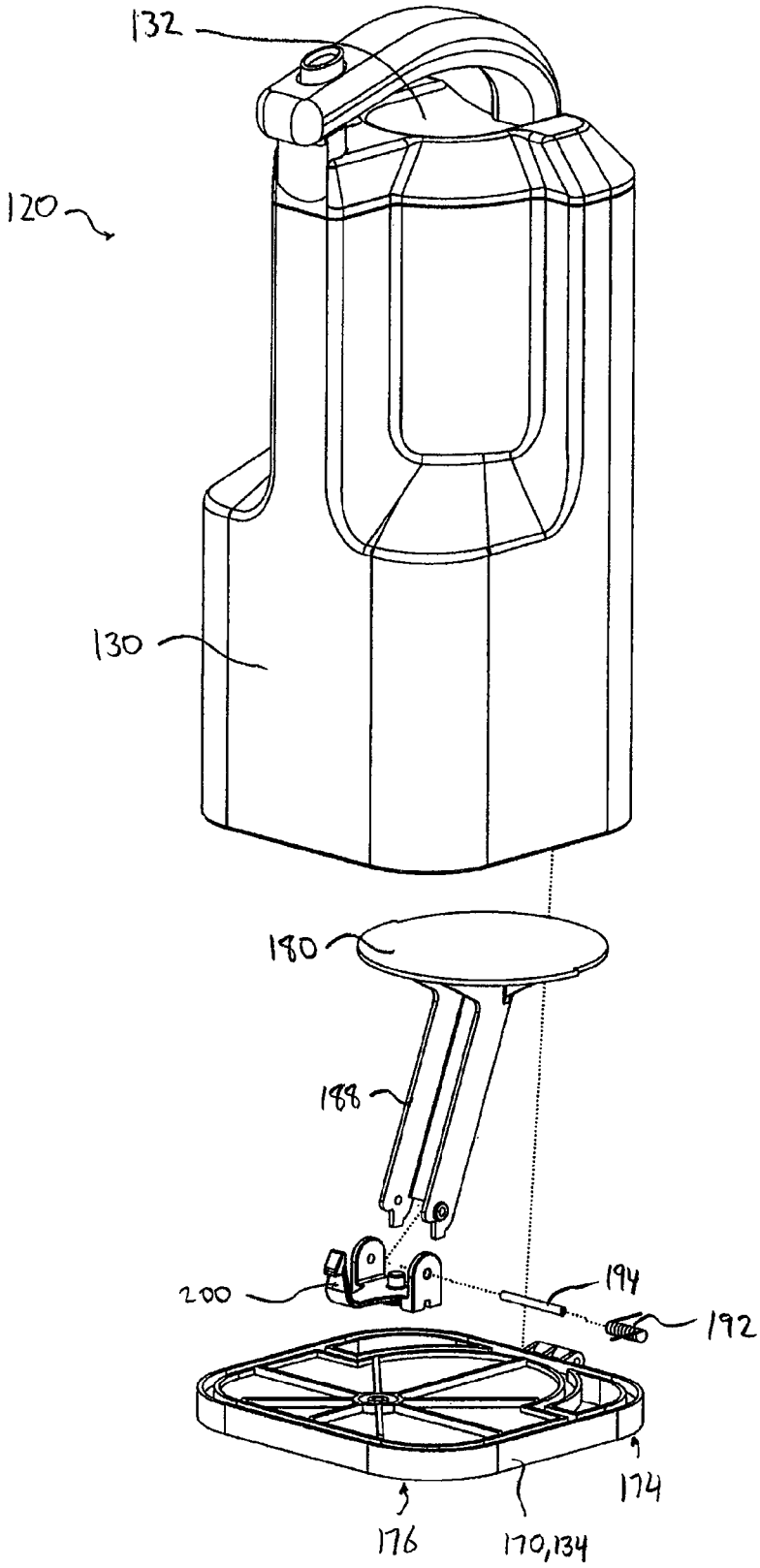
FIG. 8 is a partially exploded view of the filtration member housing of FIG. 2.

In the present example, the deflector plate 180 is configured to substantially overlie the cyclone dirt outlet 166, as described above. To keep the deflector plate 180 in the desired position, in alignment with the cyclone chamber 150, the pivot joint 190 between the strut 188 and openable wall 170 is biased using a biasing member, for example a torsion spring 192 surrounding a pin 194 (FIG. 8). The torsion spring 192 is configured to continuously bias the deflector plate 180 towards the hinge side 174 of the openable wall 170, as illustrated in FIGS. 3, 4 and 5, so that the deflector plate 180 contacts an abutment member or abutment surface within the filtration member housing 120.

In the embodiment shown, an abutment member, for example ribs 214 are provided in the dirt collection chamber 160 on the hinge side 174 for contacting the deflector plate 180. In this example, the ribs 214 form part of the longitudinally extending wall 210 and are positioned to interact with at complimentary abutment notches 216 formed on the perimeter of the deflector plate 180. In other examples, the abutment member can be another rib or different feature on the dirt chamber wall 210, a member that does not form part of wall 210 or an external element or stopper inserted into the dirt chamber 160. Optionally, the abutment member can be configured to contact the deflector plate, the support strut 188 or both to counter the force exerted by the biasing member as the openable wall 170 is moved, for example opened or closed.

Figure 7:
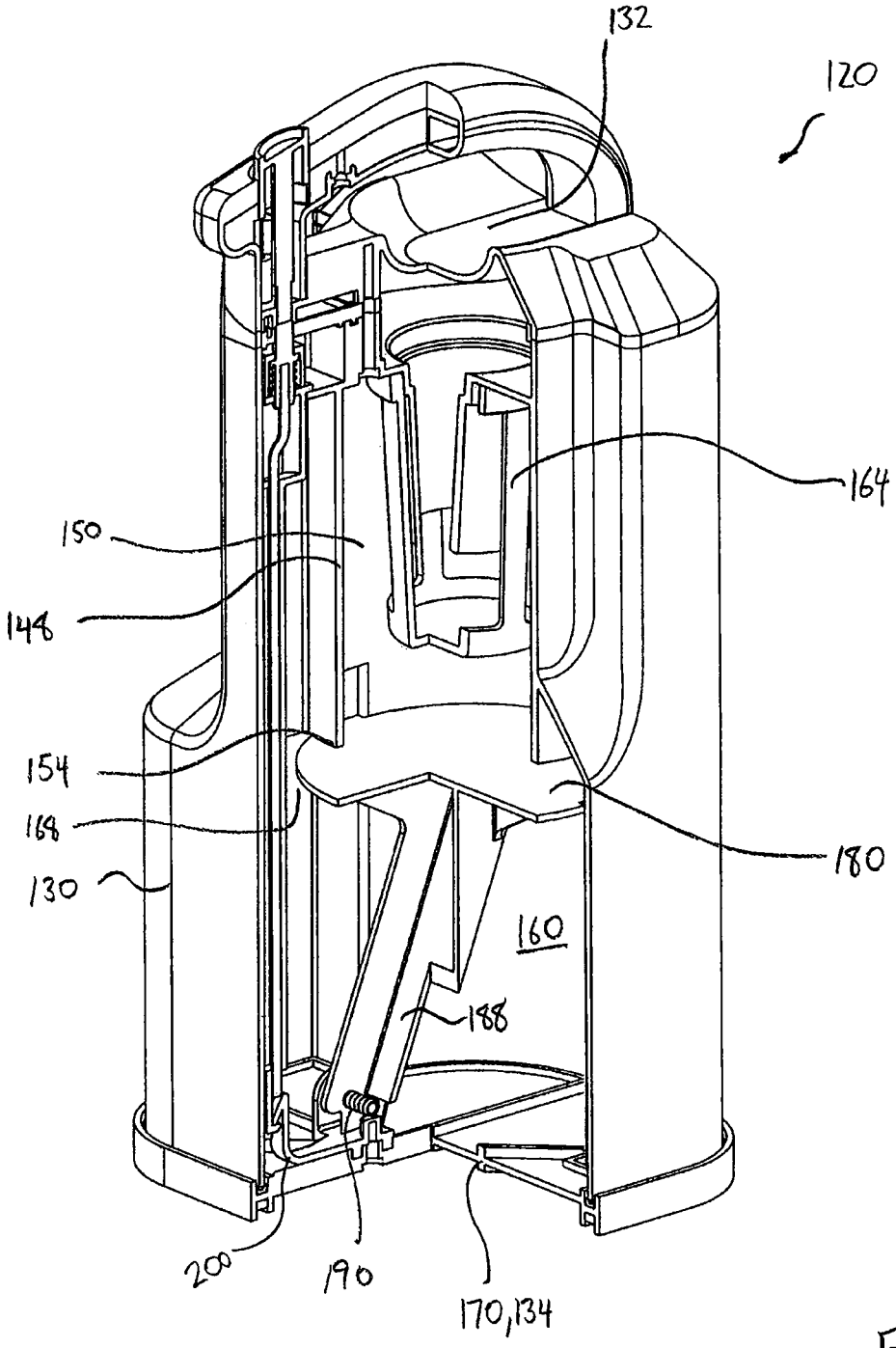
FIG. 7 is a partial section view of the filtration member housing of FIG. 2 with an openable wall in a closed position.

When the openable wall 170 is in its closed position, as exemplified in FIGS. 3 and 7, the biasing force of the torsion spring 192 forces the deflector plate 180 into its desired position, or present position, beneath the cyclone dirt outlet 166, contacting the side wall 130. As the openable wall 170 moves into an intermediary position, as exemplified in FIGS. 2 and 4, the biasing force of the torsion spring 192 keeps the deflector plate 180 disposed toward the hinge side 174 of the openable wall 170, contacting an abutment member, i.e. side wall 130, within the dirt collection chamber 160.

As exemplified in FIGS. 2-8, in a preferred example the deflector plate 180 is mounted to the openable wall 170 at a position off centre from the centrally positioned longitudinal axis 146 of the cyclone 144. Referring to FIG. 3, the pin joint connection 190 between the strut 188 and the openable wall 170 is offset from the axes 146, 218 and is disposed on the latchable side 176 of the openable wall 170, away from the hinge side 174 and hinge 172.

In examples where the pin joint 190 is off-centre, away from the hinge side 174, the strut 188, or any other suitable support member used to connect the deflector plate 180 to the openable wall 170, extends at an angle 196 to the longitudinal axis 146 of the cyclone when the openable wall 170 is in its closed position, as exemplified in FIG. 3. The angle 196 can be any suitable angle that enables the deflector plate 180 to be disposed in its in use position beneath the cyclone 144 when the openable wall 170 is closed, and enables the openable wall 170 to be opened without being jammed the deflector plate 180. The suitable angle 196 may be selected based on a number of factors including, for example, the configuration of the deflector plate 180, the cyclone chamber 150, the dirt collection chamber 160, the side walls 130 and any combination thereof. In some examples, angle 196 can be between 15 and 90 degrees. In other examples the angle 196 can be between 60 and 80 degrees.

As exemplified in FIG. 3, the dirt collection chamber has a dirt chamber axis 218 that extends through the centre of the openable wall 170. Optionally, as exemplified, the dirt chamber axis 218 is spaced apart from the longitudinal axis 146 of the cyclone chamber 150.

Figure 2:
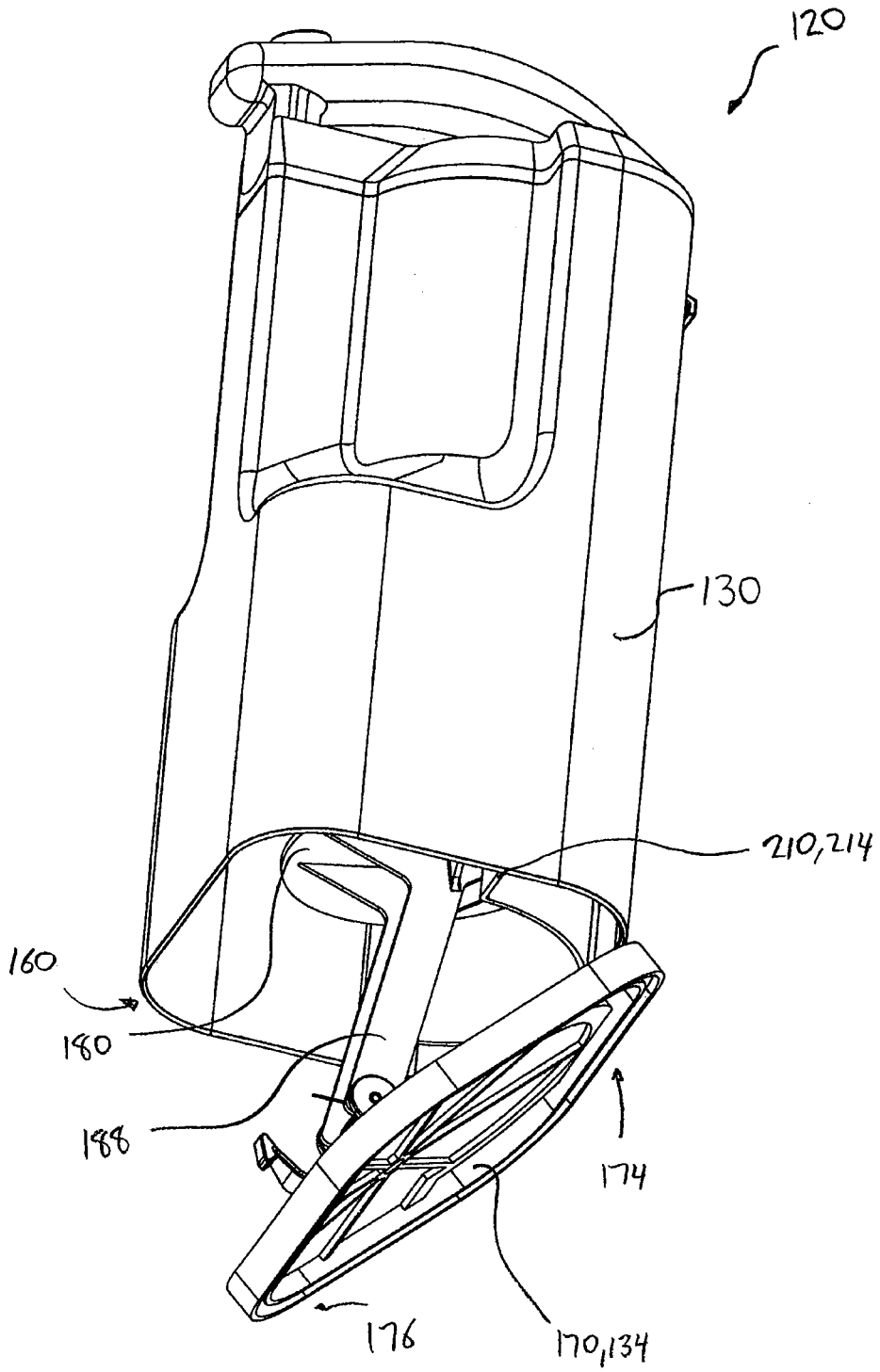
FIG. 2 is an isometric view of a filtration member housing of the surface cleaning apparatus of FIG. 1.

Generally, the dirt collection chamber 160 can be emptied by opening the openable wall 170 to an intermediate position, as exemplified in FIG. 2, 4 or 5, in which the interior of the dirt collection chamber 160 is exposed but the deflector plate 180 remains at least partially within the dirt collection chamber 160. In such a position, the deflector plate 180 is held in contact with the abutment members inside the dirt collection chamber 160 by the biasing force exerted by the torsion spring 192. In some instances, a user may wish to remove the deflector plate 180 from the dirt collection chamber 160 entirely, for example to access or service the cyclone chamber 150. In these examples, the openable plate 170 can be moved to a fully open position, as exemplified in FIG. 6, in which the deflector plate 180 can be completely removed from the dirt collection chamber 160.

Referring to FIGS. 9 and 10, another embodiment of the filtration member housing 120 is illustrated having a plate mount member, pin joint 190, that is disposed on the openable wall 170 so that the pin joint 190 is generally centered beneath the deflector plate 180 when the openable wall 170 is closed. In this embodiment, the angle 220 formed between the strut 188 and the openable wall 170, when the openable wall 170 is closed, is approximately 90 degrees. When the pin joint 190 is located directly beneath the deflector plate 180 as exemplified, it can be located off-centre, on the hinge side 174 of the openable plate 170, on the hinge side 174.

Figure 11:
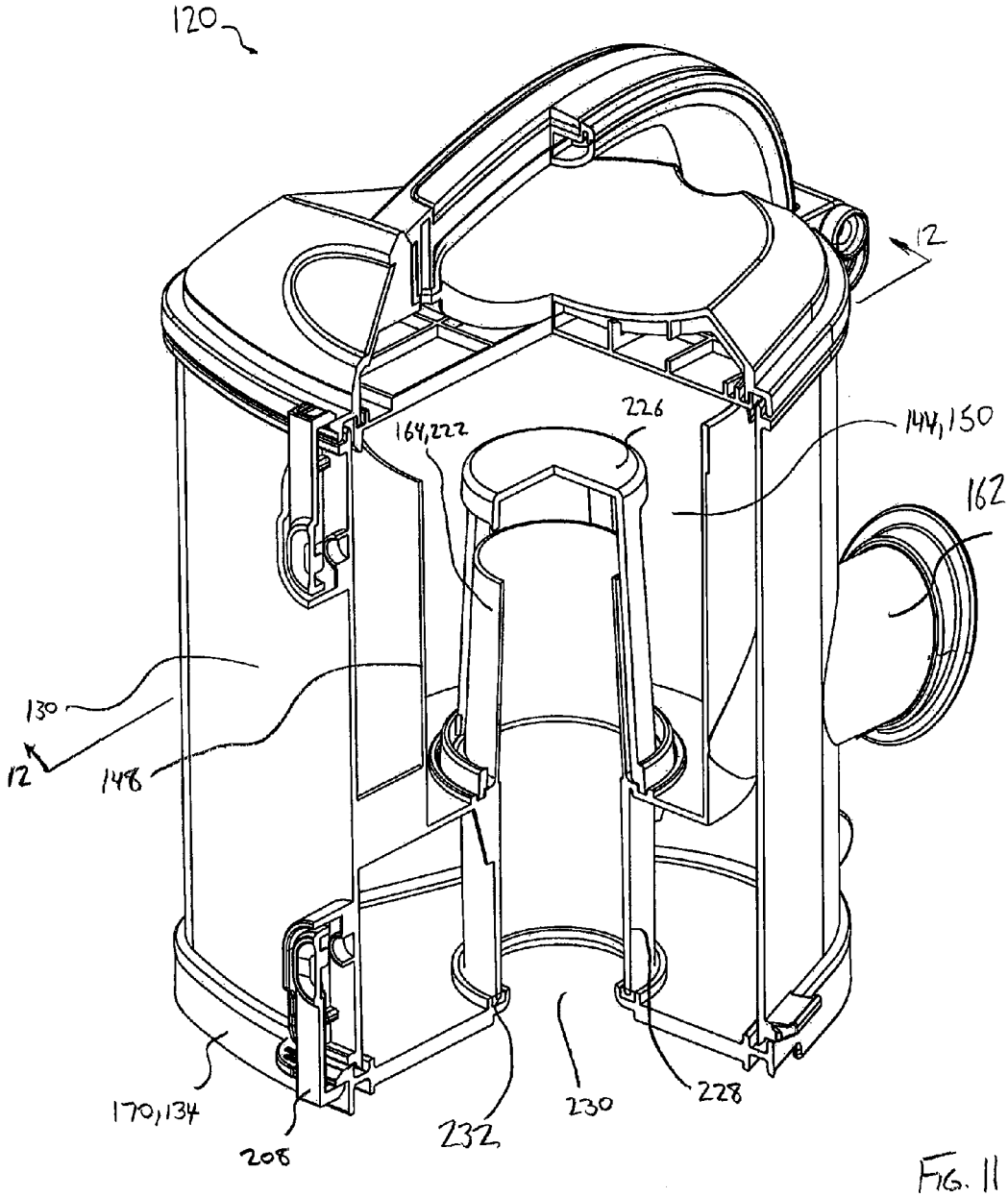
FIG. 11 is a partial cut-away view of another example of a filtration member housing.
Figure 12:
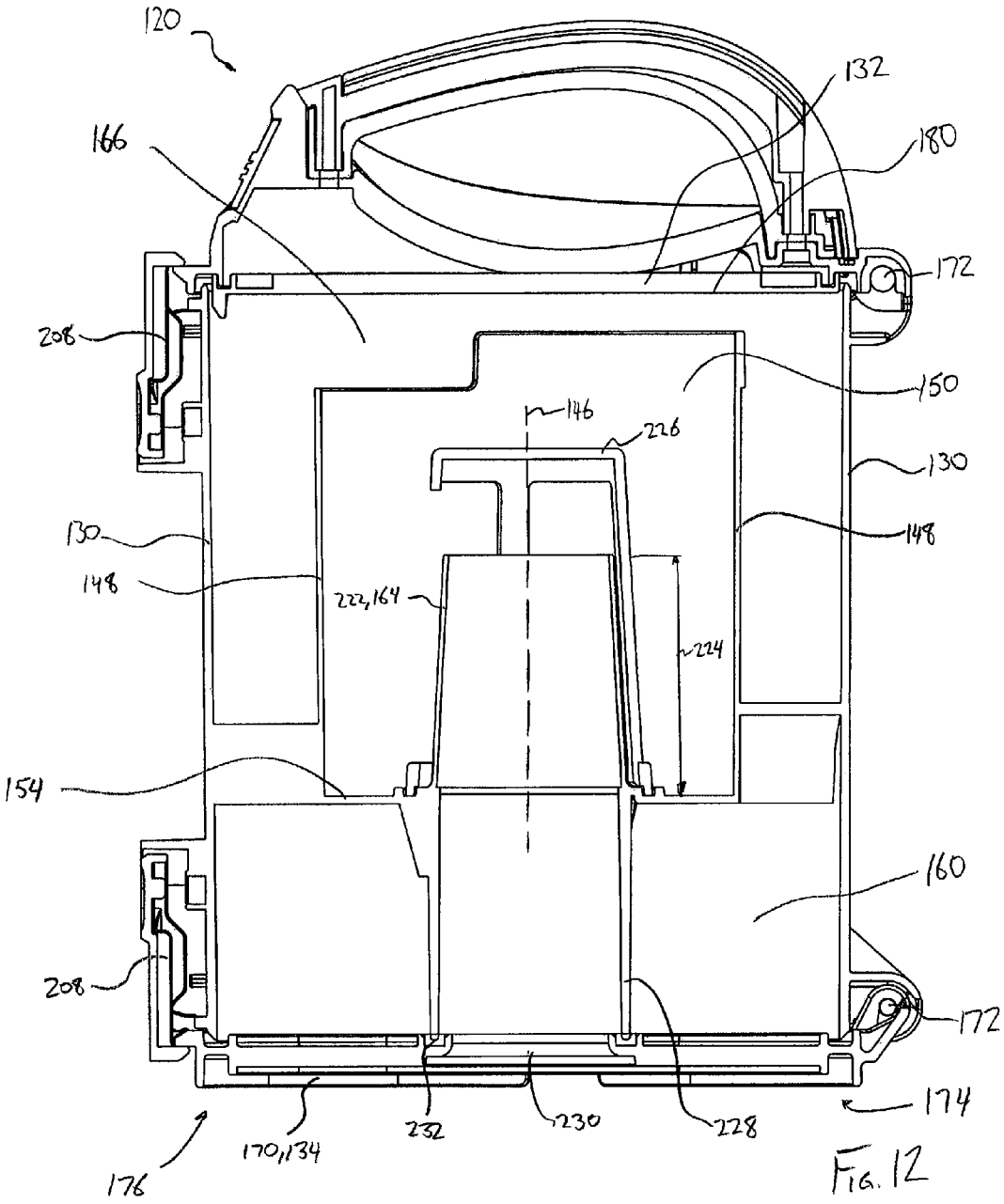
FIG. 12 is a section view taken along line 12-12 in FIG. 11, with the openable wall member in a closed position.
Figure 13:
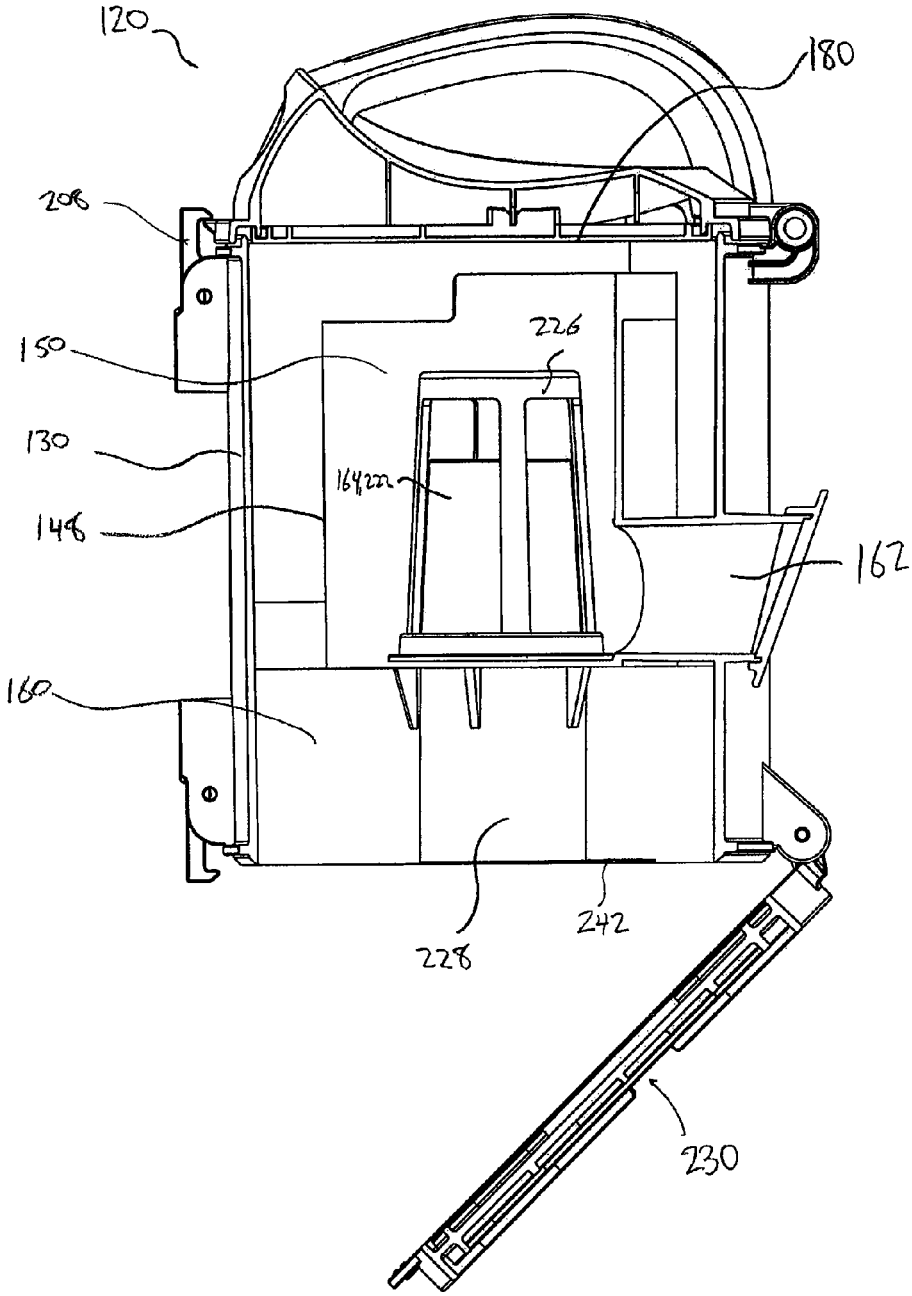
FIG. 13 is the section view of FIG. 12, with the openable wall member in an open position.

Referring to FIGS. 11-13, another embodiment of a filtration member housing 120 comprises includes a sidewall 130, a top wall 132, and a bottom wall 134. In the embodiment shown, the filtration member, or cyclone, housed in the filtration member housing 120 is a cyclone 144. In alternate embodiments, the filtration member may be, for example, a filter, such as a filter bag or a foam filter. In further alternate embodiments, the filtration member may include a plurality of cyclones, or a plurality of cyclonic stages.

The cyclone 144 may be of any suitable configuration. In the embodiment shown, the cyclone 144 extends along a longitudinal axis 146, which is generally vertically extending, and includes a generally cylindrical cyclone wall 148, which defines a cyclone chamber 150. The cyclone wall 148 is distinct from the side walls 130. In some examples, some or all of the cyclone wall 148 can coincide with portions of the side walls 130.

The cyclone 144 is positioned in the air flow passage and has a cyclone air inlet 162 in fluid communication with a cyclone air outlet 164 that passes through one end, for example the lower end 154 of the cyclone chamber 150. The cyclone 144 also includes a cyclone dirt outlet 166 spaced from the cyclone air inlet 162. In the embodiment shown, the cyclone dirt outlet 166 is disposed toward the upper end 152 of the cyclone chamber 150 and is generally defined by gap between an upper portion of the cyclone wall 148 and an inner surface of the top wall 132. In this example, the inner surface of the top wall 132 forms the deflector plate 180 that contacts dirt exiting the cyclone chamber 150 and directs it toward the cyclone dirt outlet 166.

In use, dirty air (i.e. air containing entrained dirt particles and other debris) enters the cyclone chamber 150 via the cyclone air inlet 162. Once in the cyclone chamber 150 the air circulates in a cyclonic manner which causes dirt particles and debris in the air to contact the cyclone chamber wall 148, separating the dirt and debris from the air flow. The relatively clean air is drawn from the cyclone chamber 150, downwards through the cyclone air outlet 164 while the dirt and debris is moved upwards under the force of cyclonic air flow and exits the cyclone chamber 150 via the cyclone dirt outlet 166.

In this example, the cyclone air outlet 164 comprises a hollow air flow conduit, for example vortex finder 222 that extends into the cyclone chamber 150 a suitable height 224 above the lower end 154. The height 224 can be any height that provides the desired cyclonic air flow pattern within the cyclone chamber 150 and can be based on a plurality of factors including, for example, air flow speed and cyclone chamber dimensions. To inhibit dirt and other debris from entering the cyclone air outlet 164 (and continuing into the suction motor) the vortex finder 222 may be covered with an air-permeable protective cover or screen, for example a wire mesh filter 226, configured to block the passage of dirt particles and debris. The protective cover can be any suitable cover known in the art.

In this configuration, the cyclone air inlet 162 is positioned at the same end of the cyclone as the cyclone air outlet 164; toward the lower end 154 of the cyclone chamber 150 as exemplified in FIG. 11. In other examples the cyclone air inlet 162 may be disposed at a different end than the cyclone air outlet 164.

The filtration member housing 120 also includes a dirt collection chamber 160 that is in fluid communication with the cyclone dirt outlet 166, for receiving and storing the dirt and debris separated from the air flow using the cyclone 144. In this example, at least a portion of the dirt collection chamber 160 is disposed beneath the lower end 154 of the cyclone chamber 150. Optionally, at least a portion of the generally annular space or gap formed between the cyclone wall 148 and the side wall 130 can also form part of the dirt collection chamber 160. In such examples, the dirt collection chamber 160 may surround, or at least partially surround the vortex chamber 150.

In this example, a portion of the dirt collection chamber 160 lies beneath the cyclone air outlet 164. To complete the portion of the air flow pathway fluidly linking the cyclone air outlet 164 to the suction motor (not shown), an air flow conduit, for example conduit 228 extends through the dirt collection chamber 160, fluidly connecting the cyclone air outlet 164 with an opening, for example aperture 230, in the bottom wall 134 of the filtration member housing 120. As exemplified in FIGS. 11-13 the conduit 228 is a generally cylindrical, rigid conduit that is generally straight. In other examples the conduit 228 may be of any suitable shape and size, including curved, and may be at least partially flexible. Optionally, the conduit 228 can be formed from a semi-rigid or flexible material, for example rubber or polymer, that has some degree of flexibility while still providing sufficient structural stiffness to keep the conduit 228 upstanding and to resist any forces exerted by dirt or debris in the dirt collection chamber.

The dirt chamber 160 includes an openable wall 170 that is pivotally connected to the filtration member housing 120 by a hinged joint 172. In some examples, the openable wall 170 of the dirt collection chamber 160 also forms the bottom wall 134 of the filtration member housing 120. In other examples, a separate, movable bottom wall 134 can be included beneath the openable wall 170. In the embodiment shown, the openable wall 170 defines a centre (for example the geometric centre) that separates a hinge side 174 from an opposing latchable side 176. Opening the openable wall 170 enables a user to empty the accumulated dirt and debris from the dirt collection chamber 160. In examples where the bottom wall 134 is separate from the openable wall 170 that forms the lower wall of the dirt collection chamber 160, the conduit 228 can extend through both bottom wall 134 and the openable wall 170 to complete the desired airflow pathway.

The openable wall 170 can be held in its closed position by any suitable means including a friction fit, clips, clamps or one or more latches. As exemplified in FIGS. 11-13, the latch may be an external latch 208, of any suitable type known in the art, that can be directly accessed by the user.

When the openable wall 170 is in the closed position, as exemplified in FIGS. 11 and 12, the conduit 228 provides a generally air-tight air flow pathway between the vortex finder 222 and the aperture 230, to inhibit dirt particles from the dirt collection chamber 160 from re-entering the air flow pathway. To facilitate opening of the openable wall 170 the conduit 228 is configured to provide a releasable, re-sealable connection between the vortex 222 and the aperture 230 that provides the desired air-tight conduit when the openable wall 170 is closed while still allowing the openable wall 170 to be opened to empty the dirt collection chamber 160.

In this example, as exemplified in FIGS. 11-13 the conduit 228 is mounted to the cyclone 144, for example to the lower end of the cyclone chamber 150, and extends from the cyclone to the openable endwall 170. The conduit 228 is integrally formed with, and forms a continuous extension of, the vortex finder 222 that provides a seamless air flow path from the cyclone air outlet 164 to the aperture 230. In other examples the conduit 228 can be a separate member connected to the cyclone chamber 150

The lower end of the conduit 228 can be sealed to the aperture 230 using any suitable, openable sealing or gasketing member, such as an o-ring or rubber gasket 232, that can provide the desired air-tight connection. The gasket 232 is preferably re-usable and re-sealable so the openable wall 170 can be opened and closed several times without substantially compromising the operation of the gasket 232. In this example, the conduit 228 is fixed to the vortex housing 150 and does not move or pivot when the openable door 170 is opened, as exemplified in FIG. 13.

Figure 14:
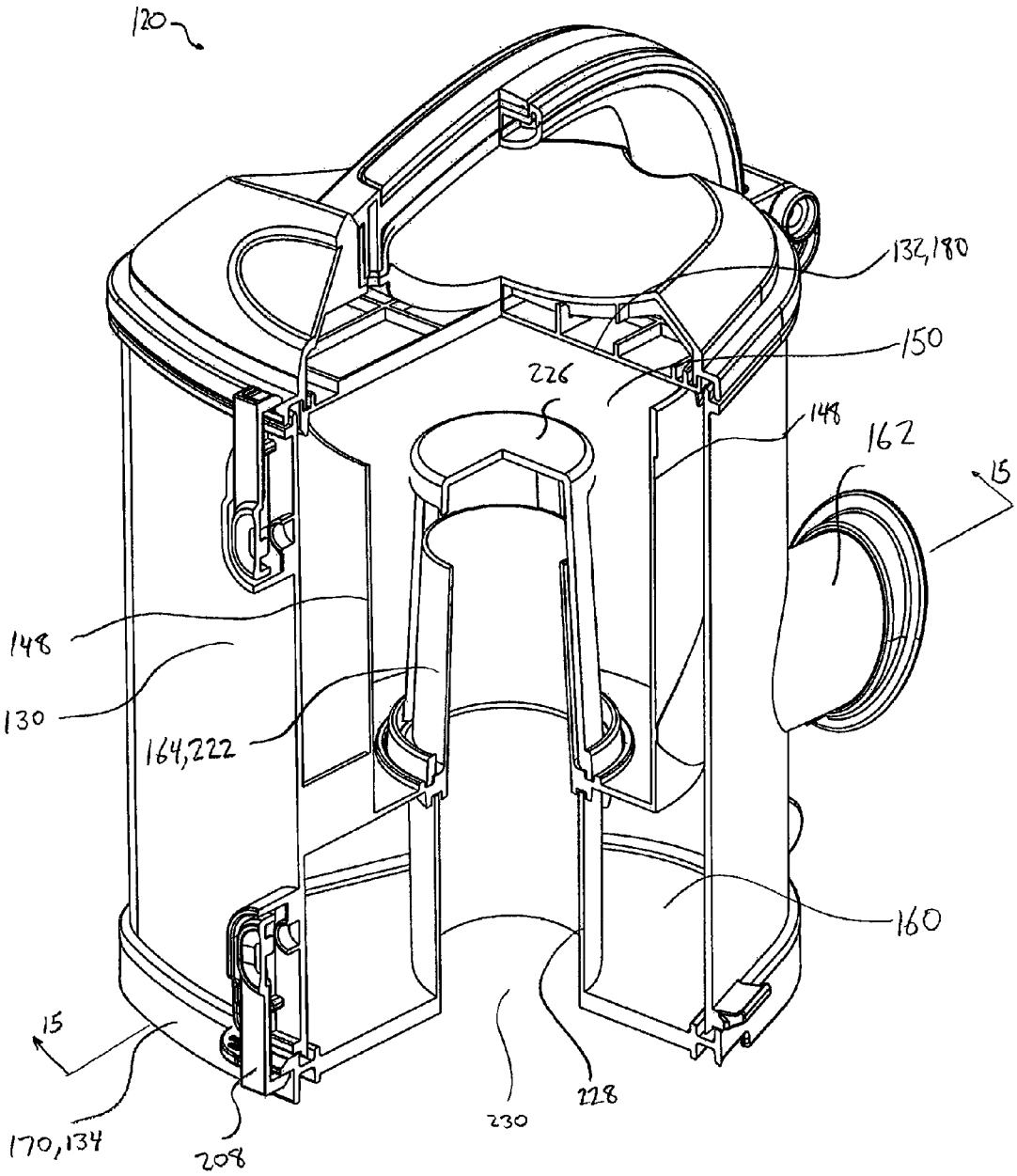
FIG. 14 is a partial cut-away view of another example of a filtration member housing.
Figure 15:
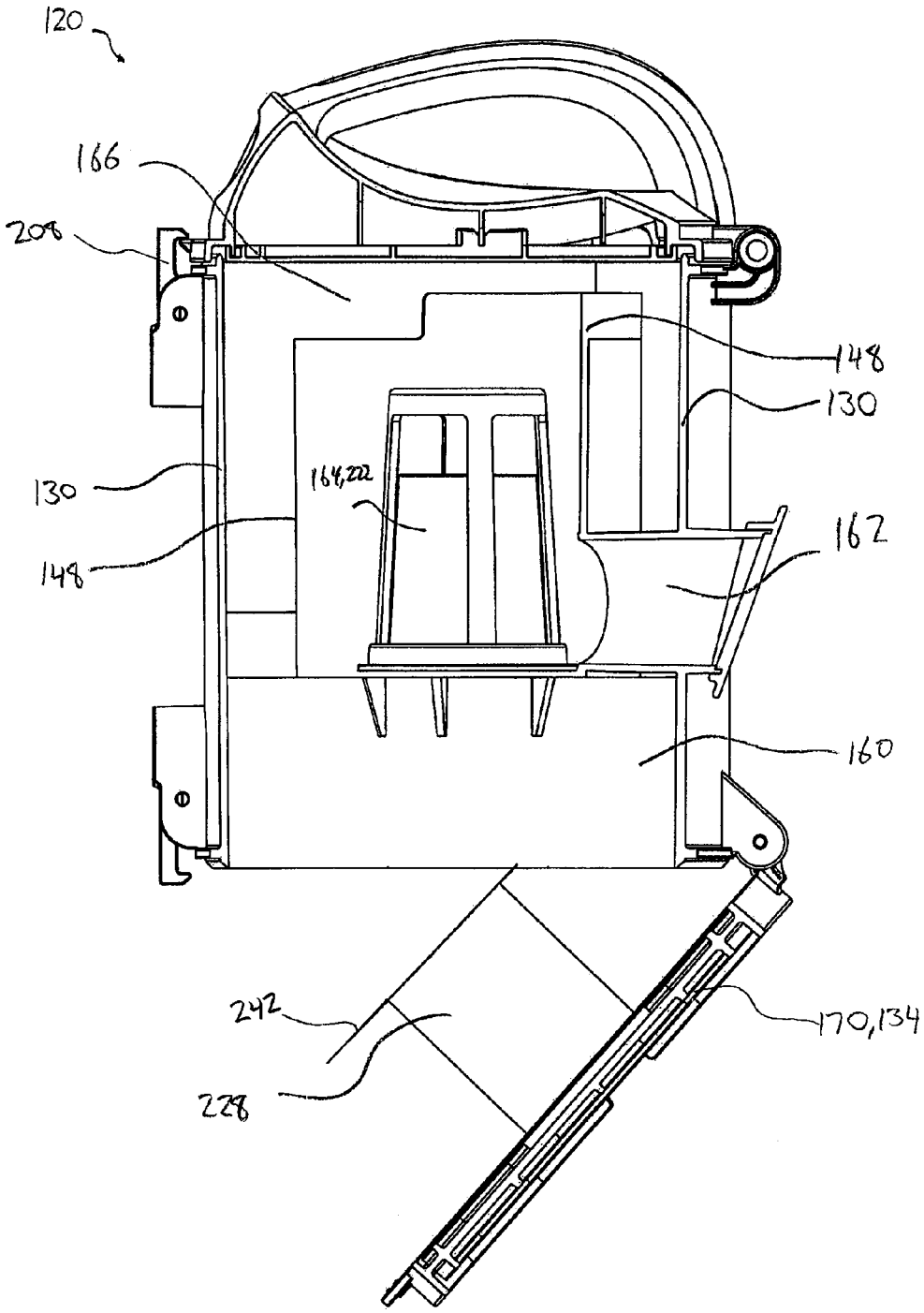
FIG. 15 is a section view taken along line 15-15 in FIG. 14, with the openable wall in an open position.

Referring to FIGS. 14 and 15, in another example, the conduit 228 may be fixedly connected to, or integrally formed with, the openable wall 170 as opposed to the cyclone chamber 150. As exemplified, the conduit 228 can be integrally formed with the openable wall 170 or, in other examples, can be fixedly coupled to the openable wall 170 using any suitable coupling means, including, for example, adhesives, welding, threaded connections and snap-fits. In this configuration, when the openable wall 170 is moved to its open position, as exemplified in FIG. 15, the conduit 228 is removed from the dirt collection chamber 160. In this example, the connection between the conduit 228 and the vortex finder 222 (or any other suitable portion of the cyclone 144) may be provided with a suitable, openable sealing member or gasket to provide the desired air-tight connection when the openable wall 170 is closed. Optionally (in any of the examples described herein), the conduit 228 can be a self-sealing conduit that formed from a material that can create the desired seal with the cyclone chamber 150 or openable wall 170. For example, the conduit 228 can be formed from a rubber or polymer composition such that an end face of the conduit itself serves as a gasketing member.

Figure 16:
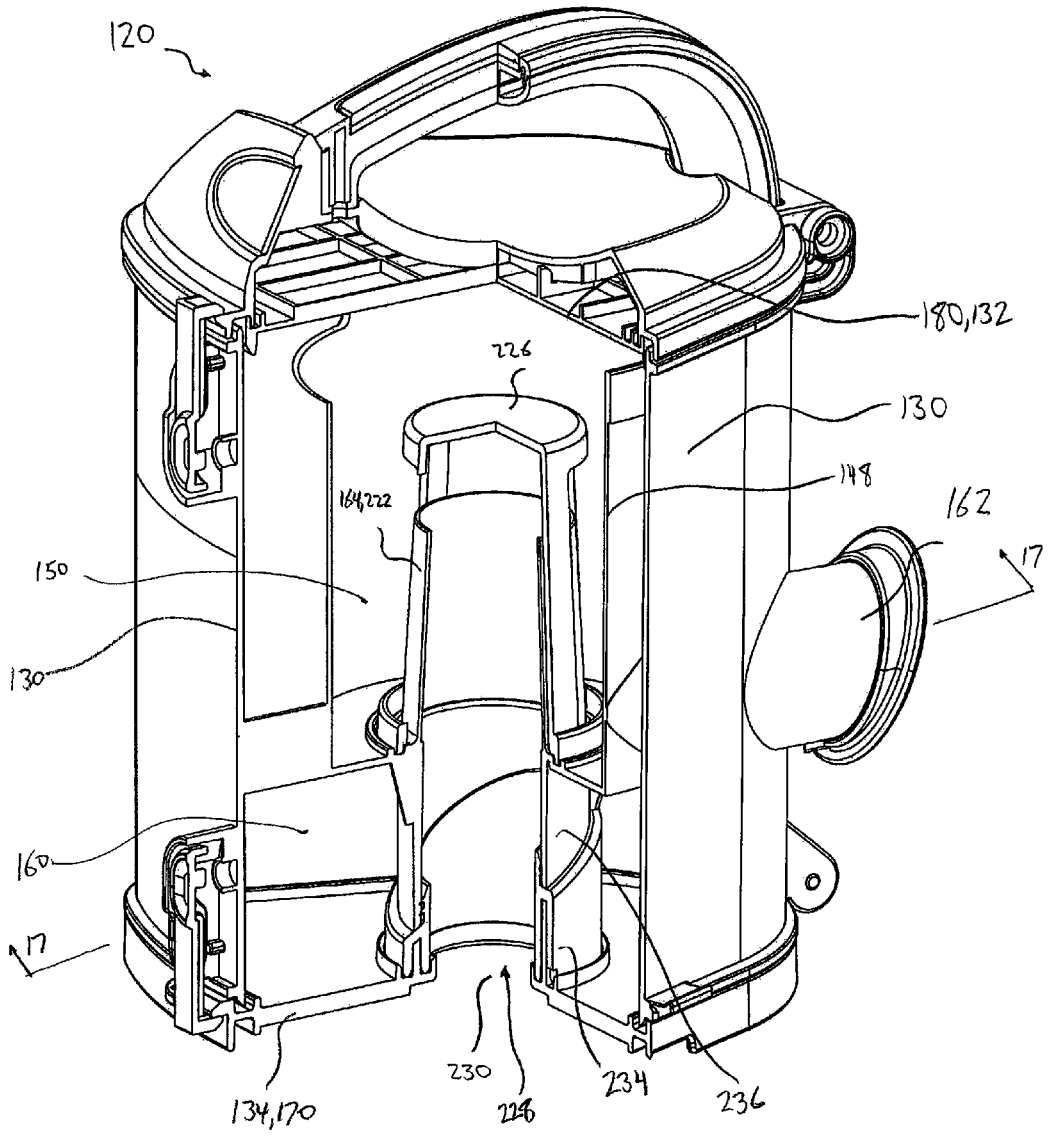
FIG. 16 is a partial cut-away view of another example of a filtration member housing.
Figure 17:
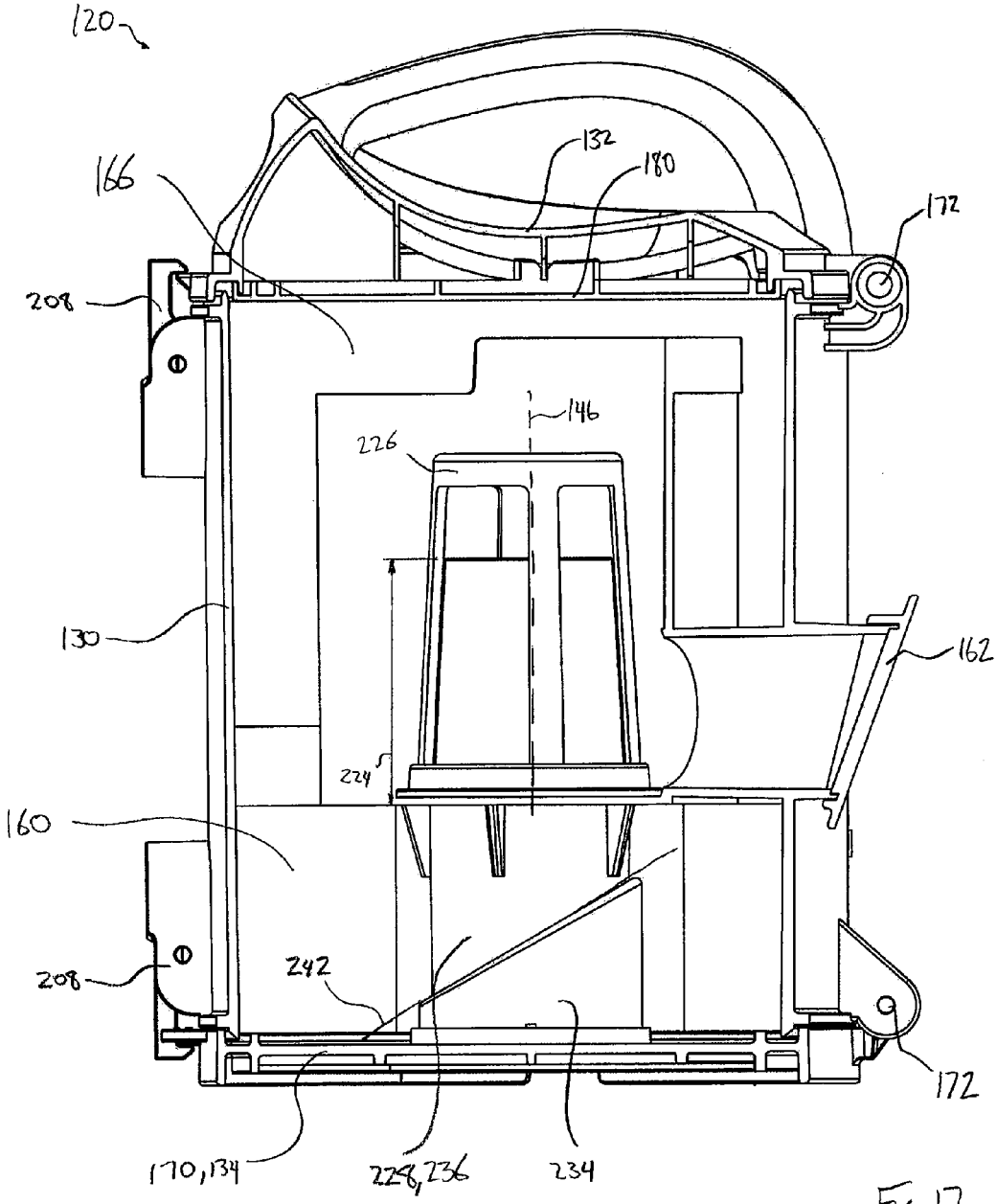
FIG. 17 is a section view taken along line 17-17 in FIG. 16, with the openable wall in a closed position.
Figure 18:
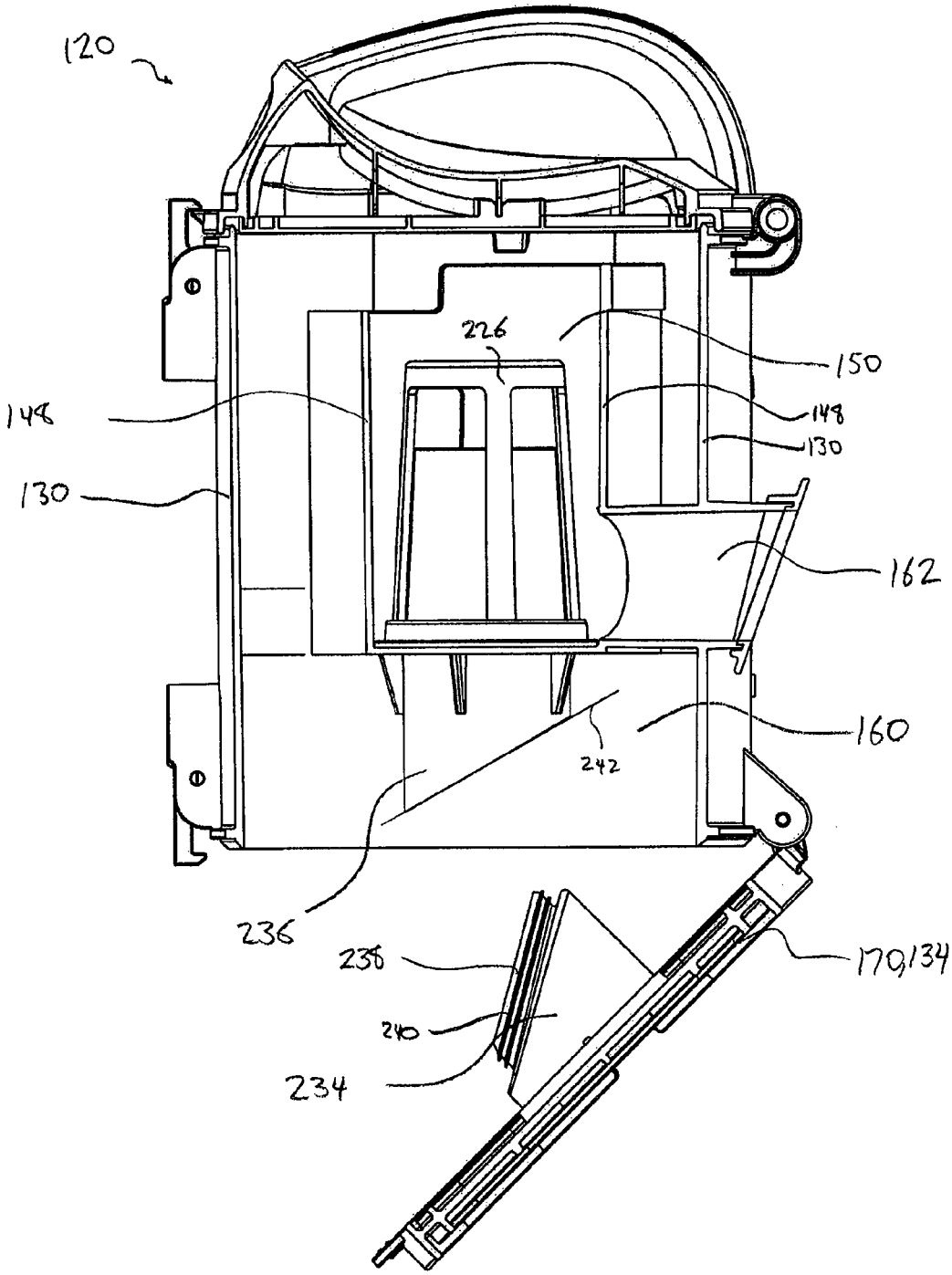
FIG. 18 is the section view of FIG. 17, with the openable wall in an open position.

Referring to FIGS. 16-18, in another example the conduit 228 may comprise two or more portions, for example lower portion 234 and upper portion 236, that are configured to sealing connect with each other to provide the air flow pathway. For example, the conduit 228 has an upper portion 236 fixed to the cyclone chamber 150 and a lower portion 234 fixed to the openable wall 170. The two portions 234, 236 of the conduit 228 are complimentary and are releasably sealable to each other to provide the desired air-tight conduit 228. In this example, the upper portion 236 of the conduit 228 may remain in the dirt collection chamber 160 when the openable wall 170 is opened, while the lower portion of the conduit 228 moves with the openable wall 170, out of the dirt collection chamber 160, as exemplified in FIG. 18.

In this example, the upper and lower portions 234, 236 can be formed from the same material or different materials. If the upper and lower portions 234, 236 are formed from the same, rigid material a gasketing member can be provided at the intersection of upper and lower portions 234, 236 to create an air-tight seal. Alternatively, as exemplified in FIGS. 16-18, the upper and lower portions 234, 236 can be formed form different materials. In the present example, the upper portion 236 is formed from the same, generally rigid material that is used to form the cyclone chamber 150, for example plastic. The lower portion 234 is formed from a more flexible, rubber material that is self-gasketing, i.e. is capable of forming an air-tight seal with the material of the upper portion 236. Optionally, the lower portion 234 includes an upstanding collar portion 238 that has outwardly projecting sealing members, for example ribs 240. The collar portion 238 is sized to fit within the downstream end of the upper portion 236, and the ribs 240 extend radially outward to create an air-tight, sealed connection. In other examples, any other suitable sealing mechanism can be used. Further, in some examples the upper portion 236 can be formed from the resilient, gasketing material and the lower portion 234 can be a rigid member.

In any of the described examples, the sealing portions of the conduit 228 can lie in a sealing plane 242. In some examples, as exemplified in FIGS. 11-15, the sealing plane 242 is generally orthogonal to the length of the conduit 228 or to axis 146 (e.g. comprising generally circular sealing faces if the conduit 228 is cylindrical). In other examples, as exemplified in FIGS. 16-18, the sealing plane 242, i.e. a plane containing the sealing surfaces of the conduit 228, can be at an angle to the direction of the air flow through the conduit 228, which is generally in the direction of axis 146. In this example, the sealing surfaces may comprise elliptical or generally arcuate faces.

Optionally, as exemplified in FIGS. 11-18, both the top wall 132 and the bottom wall 134 of the filtration member housing 120 can be openable. In such examples, both the top and bottom walls 132, 134 can be movably connected to the housing 120, for example using hinges 172, and can be securable in their closed position using any suitable means, for example latches 208. As exemplified, the dirt collection chamber 160 maybe in fluid communication with both the top and bottom walls 132, 134 providing the dirt collection chamber 160 with two opposed, openable end walls 132, 134. This configuration may provide a user with greater flexibility when emptying the dirt collection chamber 160 and may provide access for inspection and servicing of the dirt collection chamber 160 and the vortex chamber 150. An openable top wall 132 may be incorporated in any of the examples described herein.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. A surface cleaning apparatus comprising:

(a) an air flow passage extending from a dirty air inlet to a clean air outlet;

(b) a cyclone positioned in the air flow passage and having a cyclone air inlet and a cyclone air outlet at one end of a cyclone chamber, a dirt outlet spaced from the cyclone air inlet, a cyclone chamber wall and a centrally positioned longitudinal axis;

(c) a dirt collection chamber in communication with the dirt outlet and having an openable wall moveably mounted to the surface cleaning apparatus and a centrally positioned longitudinal axis, the openable wall having a centre and a mounting side;

(d) a plate moveably mounted between a closed position in which the plate is positioned at an interface of the dirt collection chamber and the cyclone and an open position in which the plate is moved away from the interface, the plate is moveably connected to the openable wall so that as the openable wall moves from a closed position to an open position, the plate is moved to the open position regardless of the orientation of the cyclone and the orientation of the plate moves to a different orientation with respect to the openable wall;

(e) a biasing member biasing the plate towards the mounting side of the openable wall; and, (f) a suction motor positioned in the air flow passage.

2. The surface cleaning apparatus of claim 1 wherein the plate is moveably connected to the openable wall at a position off centre from the centrally positioned longitudinal axis of the cyclone.

3. The surface cleaning apparatus of claim 1 wherein the plate is moveably connected to the openable wall spaced from the centre of the openable wall and towards the mounting side.

4. The surface cleaning apparatus of claim 1 further comprising a support member extending between the openable wall and the plate, and the support member extends at an angle to the longitudinal axis of the cyclone.

5. The surface cleaning apparatus of claim 1 wherein the dirt outlet comprises a gap between the plate and the cyclone chamber wall.

6. The surface cleaning apparatus of claim 1 wherein the dirt collection chamber has a longitudinally extending wall and the plate has a perimeter that is spaced from at least a portion of the longitudinally extending wall by a distance and the distance varies.

7. The surface cleaning apparatus of claim 1 further comprising an abutment member provided in the dirt collection chamber on the mounting side, the abutment member is positioned to interact with at least one of the plate and a moveable plate mount and move the plate in a direction counter the a force exerted by the biasing member as the openable wall is closed.

8. The surface cleaning apparatus of claim 7 wherein the dirt collection chamber has a longitudinally extending wall, a portion of which on the mounting side comprises the abutment member, and the plate has a perimeter that is spaced from a portion of the longitudinally extending wall and abuts the portion of the longitudinally extending wall that comprises the abutment member when the openable wall is closed.

9. The surface cleaning apparatus of claim 7 wherein the abutment member comprises a rib provided on the longitudinally extending wall of the dirt collection chamber.

10. The surface cleaning apparatus of claim 1 wherein the axis of the dirt collection chamber is spaced apart from the longitudinal axis of the cyclone chamber.

11. A surface cleaning apparatus comprising:

(a) an air flow passage extending from a dirty air inlet to a clean air outlet;

(b) a cyclone positioned in the air flow passage and having a cyclone air inlet at an inlet end of the cyclone, a cyclone air outlet, a dirt outlet spaced from the cyclone air inlet at a dirt outlet end of the cyclone and a cyclone chamber wall;

(c) a dirt collection chamber in communication with the dirt outlet and having an openable wall moveable between an open position and a closed position;

(d) a plate positioned at the dirt outlet end of the cyclone and moveable between an open position in which the plate is in a first orientation with respect to the openable wall and a closed position in which the plate is in a second orientation, different from the first orientation, with respect to the openable wall, the plate is attached to the openable wall whereby, as the openable wall moves from its closed position to the its open position, the openable wall pulls the plate from its closed position to its open position and the orientation of the plate with respect to the openable wall is adjusted; and, (e) a suction motor positioned in the air flow passage.

12. The surface cleaning apparatus of claim 11 further comprising a biasing member biasing the plate towards a sidewall of the dirt collection chamber.

13. The surface cleaning apparatus of claim 12 further comprising an abutment member positioned in the dirt collection chamber and engageable with at least one of the plate and a plate mount whereby, when the openable wall is closed, the abutment member positions the plate at a preset position.

14. The surface cleaning apparatus of claim 13 wherein the dirt collection chamber has a longitudinally extending wall and the plate has a perimeter that is spaced from a portion of the longitudinally extending wall by a distance and the distance varies.

15. The surface cleaning apparatus of claim 14 wherein a portion of the longitudinally extending wall comprises the abutment member and the plate abuts the abutment member when the openable wall is closed.

16. The surface cleaning apparatus of claim 11 wherein the openable wall has a centre and a mounting side, and the plate is moveably mounted to the openable wall spaced from the centre and towards a mounting side.

17. The surface cleaning apparatus of claim 11 further comprising a plate mount provided on the openable wall and the plate mount is positioned spaced from a centrally positioned longitudinal axis of the cyclone.

18. The surface cleaning apparatus of claim 11 wherein each of the dirt collection chamber and the cyclone has a centrally positioned longitudinal axis and the axes are spaced apart.

19. The surface cleaning apparatus of claim 11 further comprising a support member extending between the openable wall and the plate and the support member extends at an angle to a longitudinal axis of the cyclone.

20. The surface cleaning apparatus of claim 11 wherein the dirt outlet comprises a gap between the plate and the cyclone chamber wall.

21. The surface cleaning apparatus of claim 11 wherein the cyclone air outlet is at the inlet end of the cyclone.

22. The surface cleaning apparatus of claim 1 wherein the plate is pivotally mounted to the openable wall.

23. The surface cleaning apparatus of claim 1 wherein in the closed position, the plate abuts a sidewall and in the open position, the plate is spaced from the sidewall.

24. The surface cleaning apparatus of claim 1 wherein the plate is free of any connection to a sidewall of the dirt collection chamber.

25. The surface cleaning apparatus of claim 11 wherein the plate is pivotally mounted to the openable wall.

26. The surface cleaning apparatus of claim 11 wherein in the closed position, the plate abuts a sidewalk and in the open position, the plate is spaced from the sidewall.

27. The surface cleaning apparatus of claim 11 wherein the plate is free of any connection to a sidewall of the dirt collection chamber.

28. A surface cleaning apparatus comprising:

(a) an air flow passage extending from a dirty air inlet to a clean air outlet;

(b) a cyclone positioned in the air flow passage and having a cyclone air inlet at an inlet end of the cyclone, a cyclone air outlet, a dirt outlet spaced from the cyclone air inlet at a dirt outlet end of the cyclone and a cyclone chamber wall;

(c) a dirt collection chamber in communication with the dirt outlet and having an openable wall moveable between an open position and a closed position;

(d) a plate positioned at the dirt outlet end of the cyclone and moveable between an open position in which the plate is in a first orientation with respect to the openable wall and a closed position in which the plate is in a second orientation, different from the first orientation, with respect to the openable wall, the plate is attached to the openable wall whereby, as the openable wall moves from its closed position to the its open position, the openable wall pulls the plate from its closed position to its open position and the orientation of the plate with respect to the openable wall is adjusted; and, (e) a suction motor positioned in the air flow passage.

* * * * *